US008997835B2

(12) United States Patent
Kato et al.

(10) Patent No.: US 8,997,835 B2
(45) Date of Patent: Apr. 7, 2015

(54) CORE SAND FILLING DEVICE AND CORE SAND FILLING METHOD IN CORE MAKING MACHINE

(75) Inventors: Shigeyoshi Kato, Toyokawa (JP); Shuichi Tsuzuki, Toyokawa (JP); Hisashi Harada, Toyokawa (JP)

(73) Assignee: Sintokogio, Ltd., Nagoya-shi, Aichi (JP)

( * ) Notice: Subject to any disclaimer, the term of this patent is extended or adjusted under 35 U.S.C. 154(b) by 0 days.

(21) Appl. No.: 14/123,329

(22) PCT Filed: May 18, 2012

(86) PCT No.: PCT/JP2012/062864

§ 371 (c)(1),
(2), (4) Date: Jan. 3, 2014

(87) PCT Pub. No.: WO2012/165181

PCT Pub. Date: Dec. 6, 2012

(65) Prior Publication Data

US 2014/0116636 A1 May 1, 2014

(30) Foreign Application Priority Data

| | | |
|---|---|---|
| Jun. 3, 2011 | (JP) | 2011-125123 |
| Jan. 6, 2012 | (JP) | 2012-000907 |
| Mar. 26, 2012 | (JP) | 2012-069455 |

(51) Int. Cl.

| | |
|---|---|
| ***B22C 9/12*** | (2006.01) |
| ***B22C 15/20*** | (2006.01) |
| ***B22C 9/10*** | (2006.01) |
| ***B22C 7/06*** | (2006.01) |
| ***B22C 13/08*** | (2006.01) |
| ***B22C 15/24*** | (2006.01) |
| ***B22C 19/04*** | (2006.01) |

(52) U.S. Cl.

CPC ... *B22C 9/10* (2013.01); *B22C 7/06* (2013.01); *B22C 13/08* (2013.01); *B22C 15/24* (2013.01); *B22C 19/04* (2013.01)

(58) Field of Classification Search

CPC ..... B22C 15/20; B22C 15/23; B22C 15/24; B22C 15/245

USPC ..... 164/200–202, 19, 20, 21, 39, 203

See application file for complete search history.

(56) References Cited

FOREIGN PATENT DOCUMENTS

| | | |
|---|---|---|
| CN | 2506375 Y | 8/2002 |
| CN | 2701552 Y | 5/2005 |
| CN | 1968771 A | 5/2007 |
| JP | S31-006413 | 7/1956 |

(Continued)

*Primary Examiner* — Kevin P Kerns
*Assistant Examiner* — Steven Ha
(74) *Attorney, Agent, or Firm* — Drinker Biddle & Reath LLP

(57) ABSTRACT

The core sand filling device includes the core box, a blow head which is placed below the core box so as to move up and down in a relative manner to the core box and divided into a sand blowing chamber and a sand storage chamber that are communicatively connected to each other, a compressed air supply unit which is communicatively connected to the sand storage chamber and supplies compressed air into the sand storage chamber, an aeration air supply unit which is communicatively connected to the sand blowing chamber and supplies into the sand blowing chamber aeration air for suspending and fluidizing core sand inside the sand blowing chamber, and an exhaust valve which is communicatively connected to the sand blowing chamber and exhausts compressed air remaining in the sand blowing chamber.

15 Claims, 19 Drawing Sheets

(56) References Cited

FOREIGN PATENT DOCUMENTS

| | | | | | |
|---|---|---|---|---|---|
| JP | S47-013179 | 4/1972 | JP | S60-113146 | U 7/1985 |
| | | | JP | H05-305386 | A 11/1993 |
| | | | JP | H10-166106 | A 6/1998 |
| | | | JP | 2008-213036 | A 9/2008 |
| | | | JP | 2008-264867 | A 11/2008 |
| | | | JP | 2009-183984 | A 8/2009 |

CORE SAND FILLING DEVICE AND CORE SAND FILLING METHOD IN CORE MAKING MACHINE

TECHNICAL FIELD

Various aspects and embodiments of the present invention relate to a core sand filling device and a core sand filling method for filling core sand into a core box in a core making machine.

BACKGROUND ART

Conventionally, there has been made public a so-called top-blow type core making machine in which a blow head is disposed above a core box to blow core sand from an upper part of the core box to a lower part of the core box (refer to, for example, Patent Literature 1).

CITATION LIST

Patent Literature

Patent Literature 1: Japanese Published Examined Patent Application No. Sho 47-13179

SUMMARY OF INVENTION

Technical Problem

In the top-blow type core making machine disclosed in Patent Literature 1, however, the blow head is disposed above the core box, on which a core sand hopper is also disposed. As a result, the machine is increased in height and accordingly increased in dimensions, which poses a problem. Therefore, in an attempt to lower the height of, and downsize the machine as much as possible, an idea has been considered to employ a so-called under-blow type core making machine in which a blow head is disposed below a core box so as to blow core sand from a lower part of the core box to an upper part of the core box. However, in the under-blow type core making machine, the core sand is blown from the lower part of the core box to the upper part of the core box, thereby blowing the sand against the force of gravity. Thus, there is posed such a problem that this machine is inferior in filling property of the core sand to the top-blow type core making machine.

In this technical field, a core sand filling device and a core sand filling method in a core making machine which can be reduced in dimensions and also improved in filling property of core sand have been demanded.

Solution to Problem

A core sand filling device according to one aspect of the present invention is a core sand filling device in an under-blow type core making machine in which core sand is blown from a lower part of a core box to an upper part of the core box. And, the core sand filling device is provided with the core box, a blow head which is placed below the core box so as to move up and down in a relative manner to the core box and divided into a sand blowing chamber and a sand storage chamber that are communicatively connected to each other, a compressed air supply unit which is communicatively connected to the sand storage chamber and supplies compressed air into the sand storage chamber, an aeration air supply unit which is communicatively connected to the sand blowing chamber and supplies into the sand blowing chamber aeration air for suspending and fluidizing core sand inside the sand blowing chamber, and an exhaust valve which is communicatively connected to the sand blowing chamber and exhausts compressed air remaining in the sand blowing chamber.

In another embodiment, it is acceptable that a second compressed air supply unit which supplies compressed air into the sand storage chamber is communicatively connected to the sand storage chamber.

In another embodiment, it is acceptable that a second aeration air supply unit which supplies into the sand blowing chamber aeration air for suspending and fluidizing core sand inside the sand blowing chamber is communicatively connected to the sand blowing chamber.

In one embodiment, it is acceptable that a part of a bottom face of the sand storage chamber is made into an inclined face and the compressed air supply unit is attached to the inclined face.

In another embodiment, it is acceptable that the exhaust valve is communicatively connected to the sand blowing chamber via an air pipe which is communicatively connected to the aeration air supply unit.

In another embodiment, it is acceptable that a pressure sensor for measuring a pressure inside the sand blowing chamber is attached to the sand blowing chamber and a pressure sensor for measuring a pressure inside the sand storage chamber is also attached to the sand storage chamber.

In another embodiment, it is acceptable that a sand blowing nozzle is placed at a lower end of a sand blowing hole drilled into a plate attached to an upper end of the sand blowing chamber so as to protrude from the lower end of the plate.

Further, a core sand filling method according to another aspect of the present invention is a core sand filling method employed in a core making machine using the above-described core sand filling device, and the method is provided with a step which firmly attaches the core box to the sand blowing chamber, a step which actuates the aeration air supply unit to suspend and fluidize core sand inside the sand blowing chamber, a step which actuates the compressed air supply unit, thereby feeding core sand inside the sand storage chamber into the sand blowing chamber and also blowing core sand inside the sand blowing chamber into the core box, a step which stops actuation of the aeration air supply unit, a step which stops actuation of the compressed air supply unit, and a step which actuates the exhaust valve to exhaust compressed air remaining in the sand blowing chamber.

In one embodiment, it is acceptable that the aeration air supply unit and the compressed air supply unit are actuated at the same pressure.

In one embodiment, it is acceptable that a pressure for actuating the compressed air supply unit is set higher than a pressure for actuating the aeration air supply unit.

Advantageous Effects of Invention

The core sand filling device according to one aspect of the present invention is a core sand filling device in an under-blow type core making machine in which core sand is blown from a lower part of a core box to an upper part of the core box, and the core sand filling device is provided with the core box, a blow head which is placed below the core box so as to move up and down in a relative manner to the core box and divided into a sand blowing chamber and a sand storage chamber that are communicatively connected to each other, a compressed air supply unit which is communicatively connected to the sand storage chamber and supplies compressed air into the sand storage chamber, an aeration air supply unit which is communicatively connected to the sand blowing chamber and supplies into the sand blowing chamber aeration air for suspending and fluidizing core sand inside the sand blowing chamber, and an exhaust valve which is communicatively connected to the sand blowing chamber and exhausts compressed air remaining in the sand blowing chamber. It is, therefore, possible to provide various effects such as downsizing of the device and an improvement in filling property of core sand.

DESCRIPTION OF EMBODIMENTS

Hereinafter, a detailed description will be given of embodiments of the present invention with reference to the drawings. In the embodiments of the present invention, there is exemplified a shell core making machine in which resin-coated sand is blown and filled into a heated box as a core making machine to make a shell core. Further, in the embodiments of the present invention, there is exemplified an under-blow type core making machine in which core sand is blown from a lower part of a core box to an upper part of the core box. It is noted that the drawings show the core sand filling device mainly in the core making machine. Therefore, components of the core making machine other than the core sand filling device are not shown.

Figure 1:
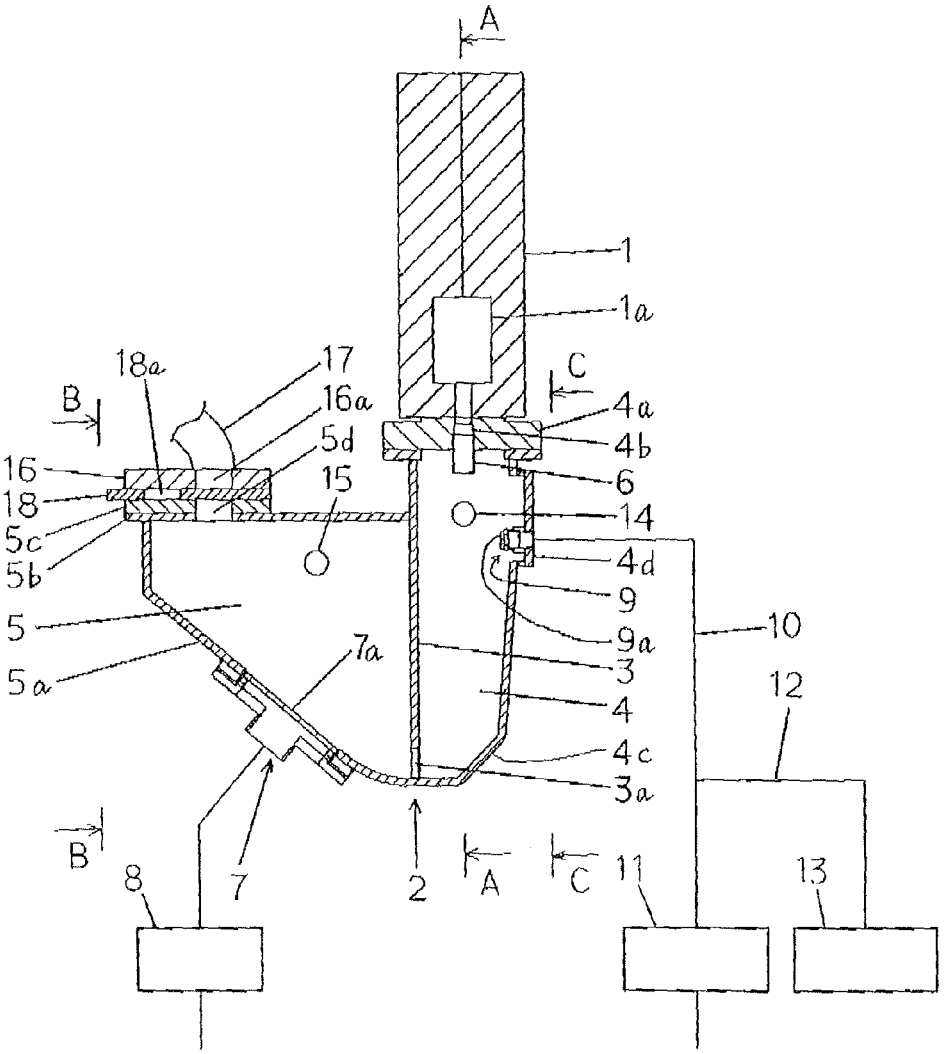
FIG. 1 is a front sectional view of a core sand filling device according to a First Embodiment of the present invention.
Figure 2:
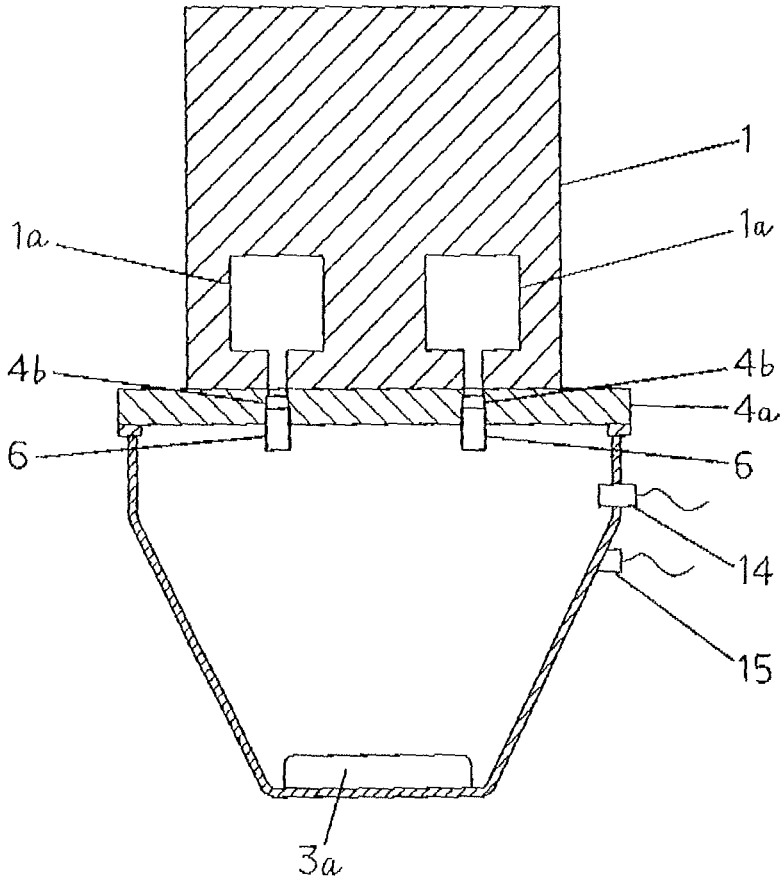
FIG. 2 is a sectional view taken along arrows A to A in FIG. 1.
Figure 3:
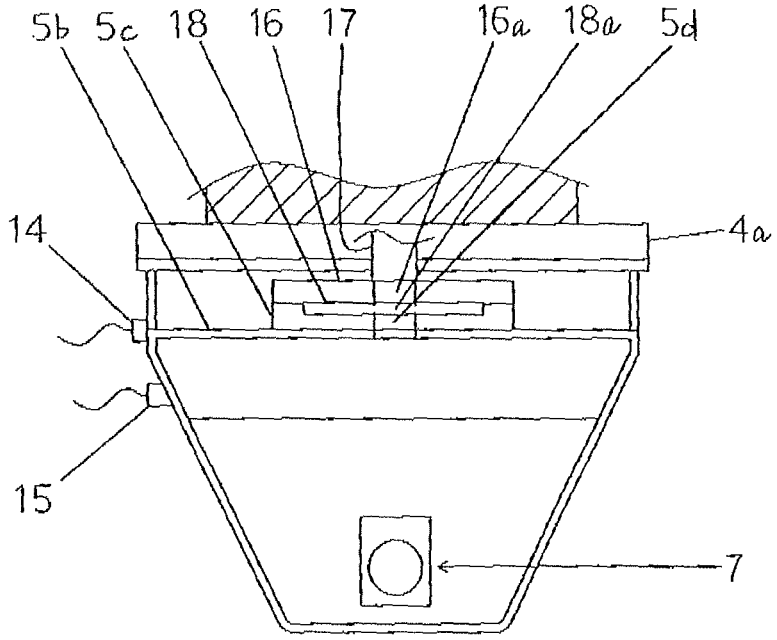
FIG. 3 is a sectional view taken along arrows B to B in FIG. 1.
Figure 4:
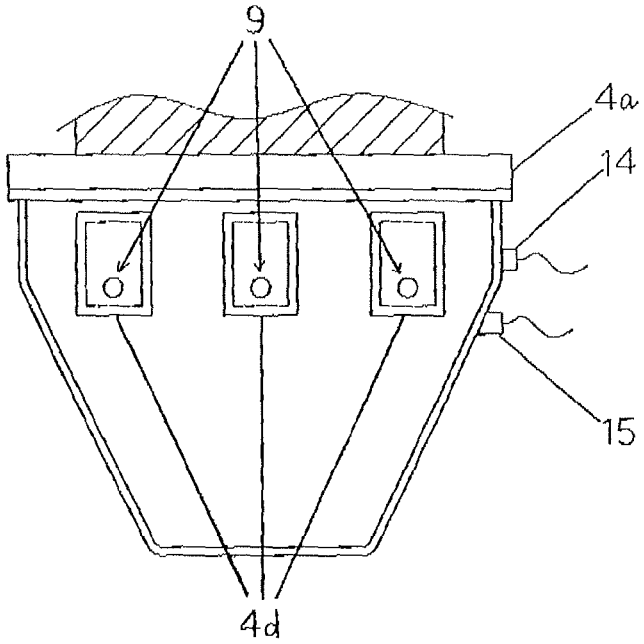
FIG. 4 is a sectional view taken along arrows C to C in FIG. 1.

First, a description will be given of a First Embodiment of the present invention. FIG. 1 is a front sectional view which shows the core sand filling device of the First Embodiment. FIG. 2 is a sectional view taken along the arrows A to A in FIG. 1. FIG. 3 is a sectional view taken along the arrows B to B in FIG. 1. FIG. 4 is a sectional view taken along the arrows C to C in FIG. 1. In FIG. 1, below a mold-matched core box 1 (a box in the present embodiment), a blow head 2 is placed so as to move up and down in a relative manner to the core box 1. The blow head 2 is coupled to a lift cylinder (not shown). In the present embodiment, the blow head 2 is to move up and down in a relative manner to the core box 1 which is disposed at a predetermined position.

It is noted that the blow head 2 is divided by a partition plate 3 installed at an intermediate position into two chambers, that is, a sand blowing chamber 4 and a sand storage chamber 5 which are mutually adjacent. Thereby, the blowing chamber 4 and the sand storage chamber 5 are disposed substantially in a horizontal direction. Then, a plate 4*a* firmly attached to the core box 1 is attached to an upper end of the sand blowing chamber 4. And, one or more sand blowing holes 4*b* are perforated into the plate 4*a*, for blowing core sand (not shown) inside the sand blowing chamber 4 into a cavity 1*a* of the core box 1. It is noted that one or more vent holes (not shown) which are communicatively connected to the cavity 1*a* are provided into the core box 1.

Then, a sand blowing nozzle 6 is placed at a lower end of the sand blowing hole 4*b* drilled into the plate 4*a* attached to the upper end of the sand blowing chamber 4 so as to protrude from the lower end of the plate 4*a*. It is noted that the sand blowing hole 4*b* is communicatively connected to the sand blowing nozzle 6.

The plate 4*a* attached to the upper end of the sand blowing chamber 4 is arranged so as to be detached from the upper end of the sand blowing chamber 4. A unit which is capable of detaching the plate 4*a* from the upper end of the sand blowing chamber 4 includes, for example, a connection unit and a clamp unit.

Further, an opening 3*a* (refer to FIG. 2) is installed at a lower center of the partition plate 3, and the sand blowing chamber 4 and the sand storage chamber 5 are communicatively connected to each other via the opening 3*a*. Still further, in the sand storage chamber 5, a part of the bottom face is made into an inclined face 5*a* (refer to FIG. 1). In addition, an upper face of a ceiling plate 5*b* of the sand storage chamber 5 is positioned so as to be lower than an upper face of the plate 4*a* in the sand blowing chamber 4.

Further, as shown in FIG. 1 and FIG. 3, a compressed air supply unit 7 for supplying compressed air into the sand storage chamber 5 is attached to a lower part of the inclined face 5*a* in the sand storage chamber 5. The compressed air supply unit 7 is communicatively connected to the sand storage chamber 5. A bronze sintered body 7*a* is attached to a leading end of the compressed air supply unit 7. Further, a base end of the compressed air supply unit 7 is communicatively connected to a compressed air source (not shown) via an on-off valve 8.

An aeration air supply unit 9 which supplies into the sand blowing chamber 4 aeration air for suspending and fluidizing core sand inside the sand blowing chamber 4 is attached to an upper part of a side wall in the sand blowing chamber 4. A bronze sintered body 9*a* is attached to a leading end of the aeration air supply unit 9, and the aeration air supply unit 9 is communicatively connected to the sand blowing chamber 4 via the sintered body 9*a*.

In the present embodiment, the aeration air supply unit 9 is mounted on a plate member 4*d* and attached via the plate member 4*d* to the upper part of the side wall in the sand blowing chamber 4. Further, the plate member 4*d* is attached so as to be detached from the side wall of the sand blowing chamber 4 by a connection unit (not shown). Then, the plate member 4*d* can be mounted by being inverted. Therefore, as compared with a state in FIG. 1, the plate member 4*d* is mounted so as to be inverted, by which the aeration air supply unit 9 is positioned so as to increase in height only by a predetermined height. In the present embodiment, as described above, the aeration air supply unit 9 can be adjusted for its height. In the present embodiment, as shown in FIG. 4, three units of the aeration air supply unit 9 are attached to the upper part of the side wall in the sand blowing chamber 4, to which the present invention shall not be, however, limited. It is acceptable that at least one unit of the aeration air supply unit 9 is provided.

Further, an air pipe 10 is communicatively connected to the base end of the aeration air supply unit 9, and an on-off valve 11 is communicatively connected to the base end of the air pipe 10. The on-off valve 11 is communicatively connected to a compressed air source (not shown).

Then, a branched air pipe 12 is communicatively connected on its way to the air pipe 10, and an exhaust valve 13 which exhausts compressed air remaining in the sand blowing chamber 4 is communicatively connected to a base end of the branched air pipe 12.

Further, in the sand blowing chamber 4, a pressure sensor 14 which measures a pressure inside the sand blowing chamber 4 is attached to an upper part of a side wall orthogonal to a side wall on which the aeration air supply unit 9 is attached. Then, a pressure sensor 15 which measures a pressure inside the sand storage chamber 5 is attached to the upper part of the side wall of the sand storage chamber 5.

Further, a plate material 5*c* is attached to an upper end of the sand storage chamber 5, and a sand hole 5*d* is drilled into the ceiling plate 5*b* and the plate material 5*c* in the sand storage chamber 5. Then, a flange 16 into which a through hole 16*a* is drilled is placed above the plate material 5*c*. And, a sand supply pipe 17 communicatively connected to the through hole 16*a* is firmly attached to an upper end of the flange 16. It is noted that the sand supply pipe 17 is communicatively connected to a sand hopper (not shown) via a sand supply hose (not shown).

Then, an on/off gate 18 into which a communicating hole 18*a* is drilled is placed between the plate material 5*c* and the flange 16, and the on/off gate 18 is opened and closed (to be moved laterally) by a cylinder (not shown). Where the blow head 2 is lowered by the lift cylinder (not shown), the plate material 5*c*, the on/off gate 18, the flange 16 and the sand supply pipe 17 are all lowered together.

Figure 5:
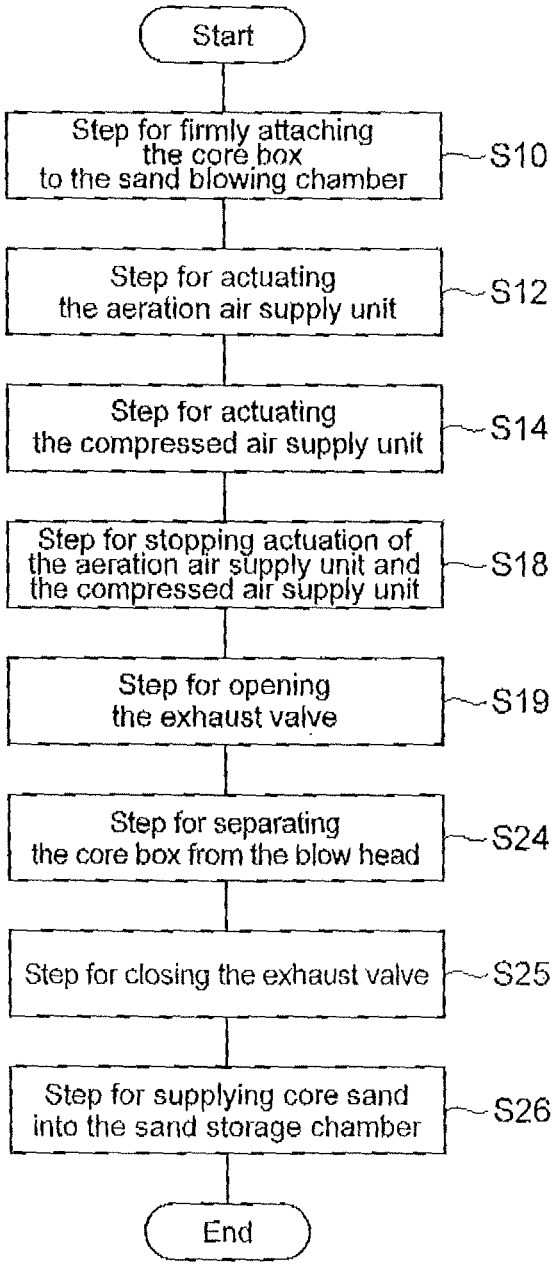
FIG. 5 is a flow chart which shows motions of the core sand filling device of the First Embodiment.

A description will be given of motions of the above-arranged core sand filling device in the core making machine. FIG. 5 is a flow chart which shows motions (core sand filling method) of the core sand filling device. As shown in FIG. 5, first, carried out is a step in which the core box 1 is firmly attached to the sand blowing chamber 4 (S10). At first, the mold-matched core box 1 is disposed at a predetermined position. Then, the on/off gate 18 is closed by the cylinder (not shown). Thereafter, the blow head 2 is raised by the lift cylinder (not shown) to develop the state shown in FIG. 1. It is noted that in the state in FIG. 1, the core box 1 and the plate 4*a* are firmly attached to each other. Further, the sand hole 5*d* is blocked by the on/off gate 18 to airtight seal the blow head 2. Still further, core sand (not shown) is contained at a necessary quantity both in the sand blowing chamber 4 and the sand storage chamber 5.

Then, in the state in FIG. 1, the on-off valve 11 is opened to actuate the aeration air supply unit 9 (S12). Then, compressed air (that is, aeration air) is ejected from the sintered body 9*a* attached to the leading end of the aeration air supply unit 9, thereby suspending and fluidizing core sand inside the sand blowing chamber 4. Then, after a predetermined period of time has passed, the on-off valve 8 is opened to actuate the compressed air supply unit 7 (S14). Thereby, the compressed air is ejected from the sintered body 7*a* attached to the leading end of the compressed air supply unit 7, and core sand inside the sand storage chamber 5 is fed into the sand blowing chamber 4. Accordingly, the core sand inside the sand blowing chamber 4 is blown into the cavity 1*a* of the core box 1 via the sand blowing nozzle 6 and the sand blowing hole 4*b*. In the meantime, the compressed air blown into the cavity 1*a* together with the core sand is exhausted through the vent holes (not shown).

Then, after a predetermined period of time has passed from actuation of the compressed air supply unit 7, the on-off valve 11 and the on-off valve 8 are closed to stop actuation of the aeration air supply unit 9 and the compressed air supply unit 7 (S18). In the meantime, due to air exhaustion through one or more vent holes (not shown) communicatively connected to the cavity 1*a* of the core box 1, the pressure difference arises between the sand blowing chamber 4 and the sand storage chamber 5. More specifically, a pressure inside the sand blowing chamber 4 becomes lower than a pressure inside the sand storage chamber 5. As a result, a pressure which is going to move into the cavity 1*a* of the core box 1 acts on core sand inside the sand blowing chamber 4 and that inside the sand storage chamber 5, by which core sand filled inside the cavity 1*a* does not fall.

Thereafter, the exhaust valve 13 is actuated (S19: the exhaust valve 13 is opened). Thereby, compressed air remaining in the sand blowing chamber 4 is exhausted. More specifically, the compressed air remaining in the sand blowing chamber 4 goes into the aeration air supply unit 9 from the sintered body 9*a* and passes through the air pipe 10 and the branched air pipe 12 and is exhausted through the exhaust valve 13. In the meantime, such flow of air is developed that the compressed air remaining in the sand blowing chamber 4 and the sand storage chamber 5 goes from the sintered body 9*a* into the aeration air supply unit 9. Thus, the core sand inside the sand storage chamber 5 joins the flow and moves into the sand blowing chamber 4, by which the sand blowing chamber 4 is filled with the core sand.

Then, after the pressure sensors 14, 15 have measured that the pressure inside the blow head 2 is zero, the blow head 2 is lowered by the lift cylinder (not shown), by which the core box 1 is separated from the blow head 2 (S24). Then, the exhaust valve 13 is closed (S25).

Then, after horizontal movement of the core box 1 to a different position, the box is opened to take out a core. Then, the on/off gate 18 is opened by the cylinder (not shown). Thereby, the core sand inside the sand hopper is supplied into the sand storage chamber 5 through the sand supply pipe 17, the through hole 16*a*, the communicating hole 18*a* and the sand hole 5*d* (S26).

Figure 6:
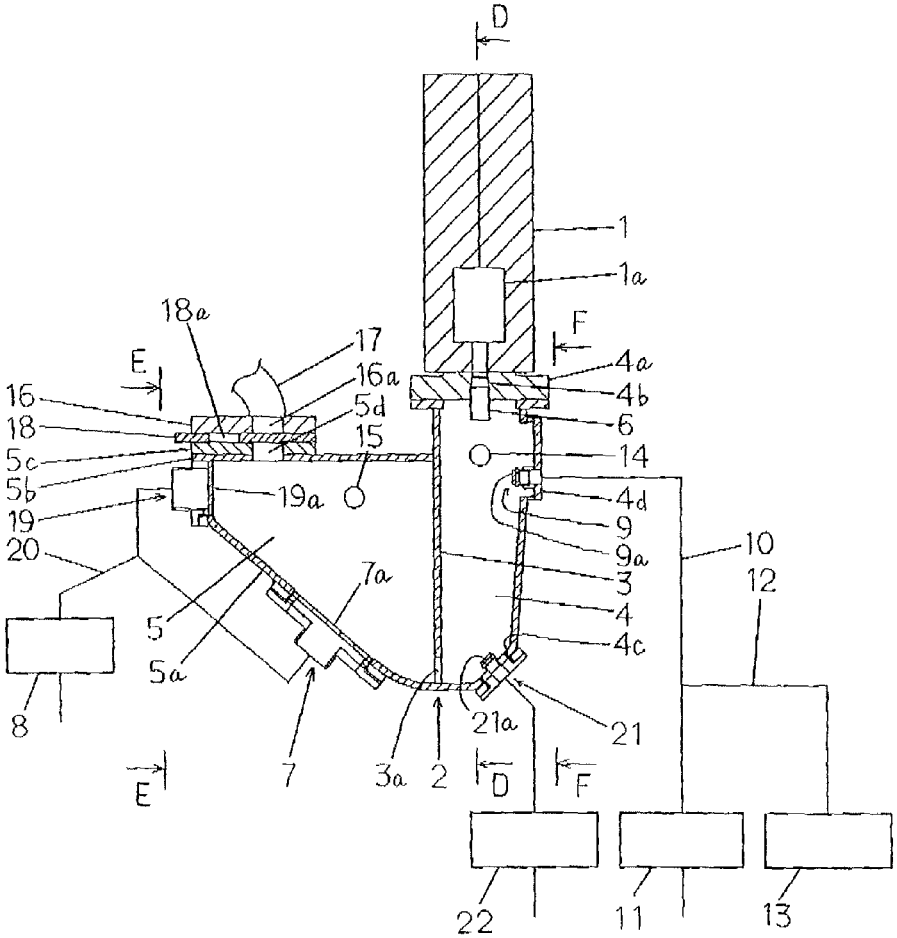
FIG. 6 is a front sectional view which shows a core sand filling device according to a Second Embodiment of the present invention.
Figure 7:
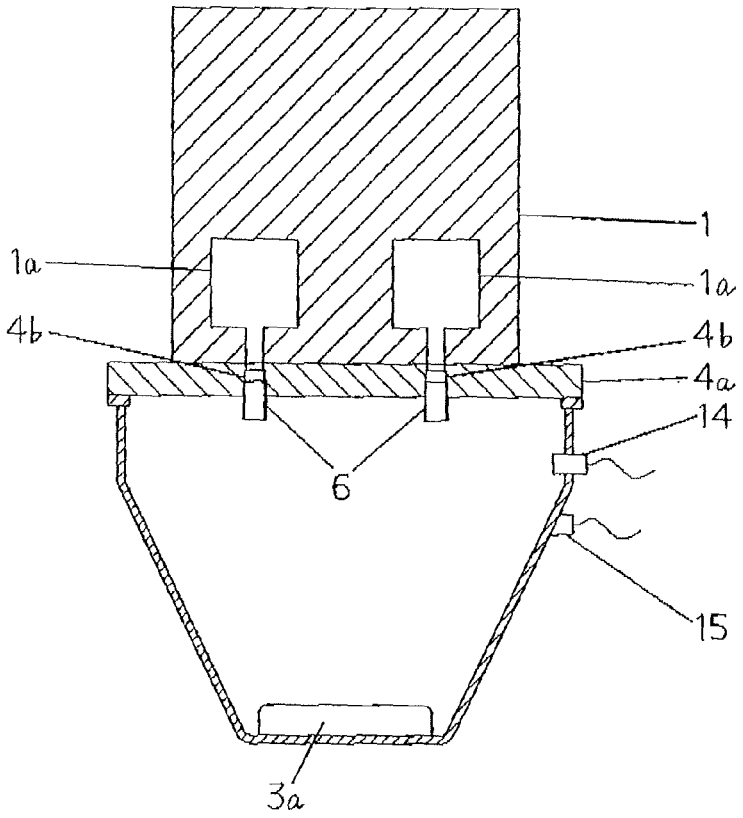
FIG. 7 is a sectional view taken along arrows D to D in FIG. 6.
Figure 8:
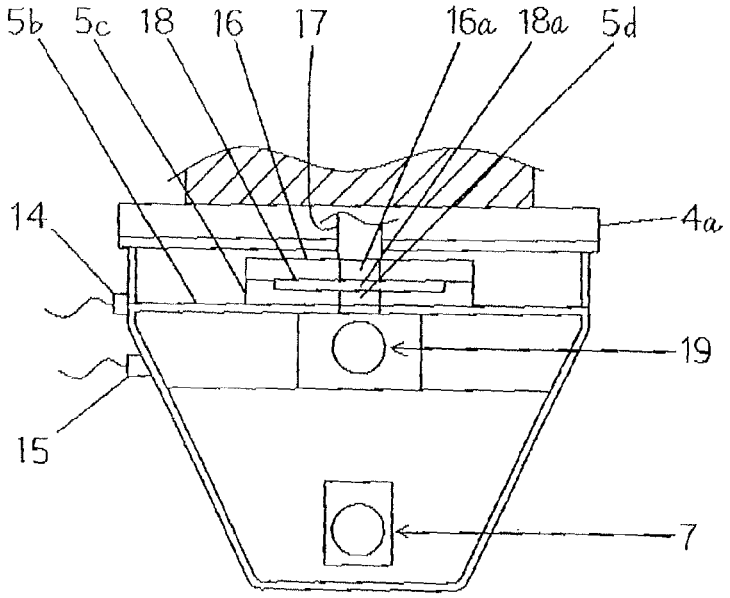
FIG. 8 is a sectional view taken along arrows E to E in FIG. 6.
Figure 9:
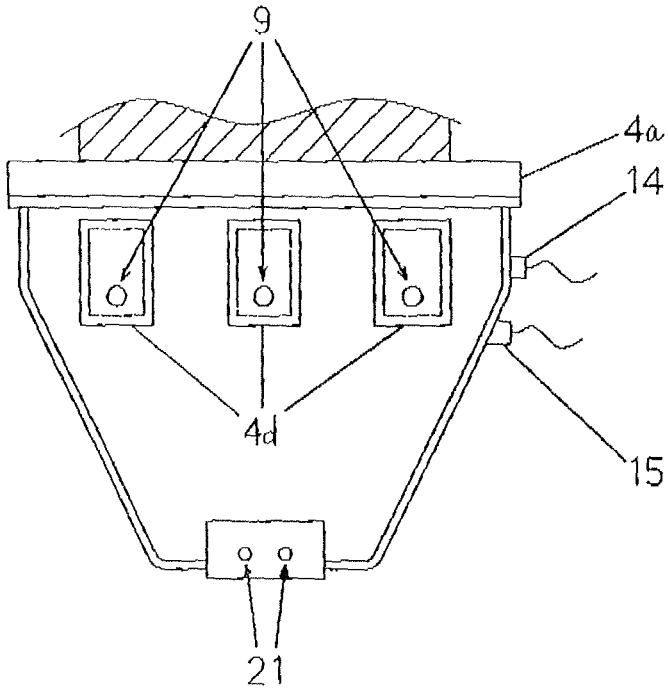
FIG. 9 is a sectional view taken along arrows F to Fin FIG. 6.

A description will be given of an embodiment different from the above-described First Embodiment as a Second Embodiment. First, there will be described points different from those of the First Embodiment. FIG. 6 is a front sectional view which shows a core sand filling device of the Second Embodiment. FIG. 7 is a sectional view taken along the arrows D to D in FIG. 6, FIG. 8 is a sectional view taken along the arrows E to E in FIG. 6, FIG. 9 is a sectional view taken along the arrows F to F in FIG. 6. In the Second Embodiment, as shown in FIG. 6, in a sand storage chamber 5, a second compressed air supply unit 19 for supplying compressed air into the sand storage chamber 5 is attached to a side wall extending in a perpendicular direction from an upper end of an inclined face 5*a*. The second compressed air supply unit 19 is communicatively connected to the sand storage chamber 5. It is noted that a bronze sintered body 19*a* is attached to a leading end of the second compressed air supply unit 19. Further, the second compressed air supply unit 19 is communicatively connected to an on-off valve 8 together with the compressed air supply unit 7 via an air pipe 20.

Further, in a sand blowing chamber 4, on an inclined face 4*c* which is a part of a bottom face, there is attached a second aeration air supply unit 21 which supplies into the sand blowing chamber 4 aeration air for suspending and fluidizing core sand inside the sand blowing chamber 4. The second aeration air supply unit 21 is communicatively connected to the sand blowing chamber 4. It is noted that a bronze sintered body 21*a* is attached to the leading end of the second aeration air supply unit 21. In the present embodiment, as shown in FIG. 9, two units of the second aeration air supply unit 21 are attached to the inclined face 4*c* which is a part of the bottom face in the second sand blowing chamber 4. The present invention shall not be, however, limited thereto. It is acceptable that at least one unit of the second aeration air supply unit 21 is attached. Further, a base end of the second aeration air supply unit 21 is communicatively connected to a compressed air source (not shown) via an on-off valve 22.

The Second Embodiment is different in these points from the First Embodiment but similar in other points to the First Embodiment. It is noted that the same components as those of the First Embodiment are given the same reference numerals, with a description thereof omitted here.

A description will be given of actuation of the above-arranged Second Embodiment. First, a mold-matched core box 1 is disposed at a predetermined position. Then, an on/off gate 18 is closed by a cylinder (not shown). Thereafter, a blow head 2 is raised by a lift cylinder (not shown) to develop the state in FIG. 6. It is noted that in the state in FIG. 6, a plate 4*a* is firmly attached to the core box 1. Further, a sand hole 5*d* is blocked by the on/off gate 18 to airtight seal the blow head 2. A necessary quantity of core sand (not shown) is placed into each of the sand blowing chamber 4 and the sand storage chamber 5.

Next, in the state in FIG. 6, the on-off valve 11 and the on-off valve 22 are opened to actuate an aeration air supply unit 9 and the second aeration air supply unit 21. Accordingly, compressed air (that is, aeration air) is ejected from a sintered body 9*a* attached to the leading end of the aeration air supply unit 9 and a sintered body 21*a* attached to the leading end of the second aeration air supply unit 21, thereby suspending and fluidizing core sand inside the sand blowing chamber 4. Then, after a predetermined period of time has passed, the on-off valve 8 is opened to actuate a compressed air supply unit 7 and a second compressed air supply unit 19. Thereby, compressed air is ejected from a sintered body 7*a* attached to the leading end of the compressed air supply unit 7 and a sintered body 19*a* attached to the leading end of the second compressed air supply unit 19, by which core sand inside the sand storage chamber 5 is fed into the sand blowing chamber 4. Accordingly, core sand inside the sand blowing chamber 4 is blown into a cavity 1*a* of the core box 1 via a sand blowing nozzle 6 and a sand blowing hole 4*b*. In the meantime, compressed air blown into the cavity 1*a* together with the core sand is exhausted through the vent holes (not shown).

Then, after a predetermined period of time has passed from start of actuating the compressed air supply unit 7 and the second compressed air supply unit 19, the on-off valve 11, the on-off valve 22 and the on-off valve 8 are closed to stop actuation of the aeration air supply unit 9, the second aeration air supply unit 21, the compressed air supply unit 7 and the second compressed air supply unit 19. In the meantime, air exhaustion is carried out through the vent holes (not shown) communicatively connected to the cavity 1*a* of the core box 1, thus resulting in a difference in pressure between the sand blowing chamber 4 and the sand storage chamber 5. More specifically, the pressure inside the sand blowing chamber 4 becomes lower than the pressure inside the sand storage chamber 5. As a result, a pressure which is going to move into the cavity 1*a* of the core box 1 acts on the core sand inside the sand blowing chamber 4 and that inside the sand storage chamber 5, by which the core sand filled inside the cavity 1*a* does not fall.

Thereafter, the exhaust valve 13 is actuated (the exhaust valve 13 is opened), thereby exhausting compressed air remaining in the sand blowing chamber 4. More specifically, the compressed air remaining in the sand blowing chamber 4 goes into the aeration air supply unit 9 from the sintered body 9*a*, passes through an air pipe 10 and a branched air pipe 12, and is exhausted from the exhaust valve 13. In the meantime, such flow of air is developed that compressed air remaining in the sand blowing chamber 4 and the sand storage chamber 5 goes from the sintered body 9*a* into the aeration air supply unit 9. Thus, the core sand inside the sand storage chamber 5 joins the flow and moves into the sand blowing chamber 4, by which the sand blowing chamber 4 is filled with the core sand.

Then, after the pressure sensors 14, 15 have measured that the pressure inside the blow head 2 is zero, the blow head 2 is lowered by the lift cylinder (not shown), by which the core box 1 is separated from the blow head 2. Then, the exhaust valve 13 is closed.

Then, after horizontal movement of the core box 1 to a different position, the box is opened to take out a core. Then, the on/off gate 18 is opened by the cylinder (not shown). Thereby, the core sand inside the sand hopper is supplied into the sand storage chamber 5 through the sand supply pipe 17, the through hole 16*a*, the communicating hole 18*a* and the sand hole 5*d*.

In the First Embodiment and Second Embodiment, the aeration air supply unit 9 and the compressed air supply unit 7 are actuated at the same pressure. The same actuation pressure is advantageous in reducing consumption of air.

In the First Embodiment and Second Embodiment, as described above, the aeration air supply unit 9 and the compressed air supply unit 7 are actuated at the same pressure to which the present invention shall not be, however, limited. It is acceptable that the compressed air supply unit 7 is actuated at a higher pressure than the aeration air supply unit 9. In this case, the pressure inside the sand storage chamber 5 is made higher than the pressure inside the sand blowing chamber 4, thereby developing a great difference in pressure. Therefore, such an advantage is provided that core sand is allowed to move easily from the sand storage chamber 5 to the sand blowing chamber 4.

In the First Embodiment and Second Embodiment, such an arrangement is made that the blow head 2 divided into the sand blowing chamber 4 and the sand storage chamber 5 which are communicatively connected to each other is placed below the core box 1 so as to move up and down in a relative manner to the core box 1. Thereby, as compared with a top-blow type core making machine, the core sand filling device can be decreased in width in a perpendicular direction and such effects are obtained that it can be downsized. Further, in the First Embodiment and Second Embodiment, there are provided two air supply units, that is, the compressed air supply unit 7 which is communicatively connected to the sand storage chamber 5 and also supplies compressed air into the sand storage chamber 5 and the aeration air supply unit 9 which is communicatively connected to the sand blowing chamber 4 and also supplies into the sand blowing chamber 4 aeration air for suspending and fluidizing core sand inside the sand blowing chamber 4, thereby blowing and filling the core sand by combining compressed air ejected from each of the air supply units. Therefore, such effects are obtained that even the under-blow type core making machine is able to improve filling property of core sand.

Further, in the First Embodiment and Second Embodiment, such an arrangement is made that a part of the bottom face of the sand storage chamber 5 is made into the inclined face 5*a* and the compressed air supply unit 7 is attached to the inclined face 5*a*. The operating effects of this arrangement will be described. Core sand supplied into the sand storage chamber 5 is usually formed into a conical shape inside the sand storage chamber 5 depending on a repose angle of the sand. In this case, however, the height of a sand layer is low at a part where the partition plate 3 is in contact with core sand. Therefore, when the core sand is allowed to move from the sand storage chamber 5 to the sand blowing chamber 4, so-called blow-by of air may take place in which the core sand is not mixed well with air and only the air passes through the opening 3*a*. However, as described above, the compressed air supply unit 7 is attached to the inclined face 5*a* which is a part of the bottom face of the sand storage chamber 5, from which compressed air is supplied into the sand storage chamber 5. A pile of the core sand formed into a conical shape collapses, thereby, agitating the core sand. Then, the core sand is made flat inside the sand storage chamber 5, and the sand layer is increased in height at a part where the partition plate 3 is in contact with the core sand. As a result, it is possible to prevent the above-described blow-by of air and also increase a quantity of core sand moving from the sand storage chamber 5 to the sand blowing chamber 4, that is, a quantity of effectively usable sand.

Still further, in the First Embodiment and Second Embodiment, such an arrangement is made that the exhaust valve 13 is communicatively connected to the sand blowing chamber 4 via an air pipe communicatively connected to the aeration air supply unit 9. According to the above arrangement, air to be exhausted goes into the aeration air supply unit 9 from the sintered body 9*a* and, thereby, the aeration air supply unit 9 also acts as an air exhaustion unit. As a result, this arrangement is advantageous in that even when sand may be clogged in the sintered body 9*a* on air exhaustion, compressed air is subsequently ejected from the sintered body 9*a* and, therefore, sand clogged in the sintered body 9*a* can then be removed.

Further, as shown in the Second Embodiment, such an arrangement is acceptable that the second compressed air supply unit 19 is provided in addition to the compressed air supply unit 7. The above-described arrangement is advantageous in that a pile of core sand in a conical shape collapses inside the sand storage chamber 5, thereby accelerating agitation of the core sand. The above arrangement is also advantageous in that core sand moves more smoothly from the sand storage chamber 5 to the sand blowing chamber 4.

Further, as shown in the Second Embodiment, such an arrangement is also acceptable that the second aeration air supply unit 21 is provided in addition to the aeration air supply unit 9. The above-described arrangement is advantageous in that the core sand inside the sand blowing chamber 4 is suspended and fluidized in a more accelerated manner.

Still further, in the First Embodiment and Second Embodiment, such an arrangement is made that the pressure sensor 14 for measuring the pressure inside the sand blowing chamber 4 is attached to the sand blowing chamber 4 and the pressure sensor 15 for measuring the pressure inside the sand storage chamber 5 is also attached to the sand storage chamber 5. The above-described arrangement is advantageous in easily measuring a difference in pressure between the sand blowing chamber 4 and the sand storage chamber 5.

In addition, in the First Embodiment and Second Embodiment, such an arrangement is made that the sand blowing nozzle 6 is placed at the lower end of the sand blowing hole 4*b* drilled into the plate 4*a* attached to the upper end of the sand blowing chamber 4 so as to protrude from the lower end of the plate 4*a*. Here, a detailed description will be given of effects of the above-described arrangement. As described previously, in the First Embodiment of the present invention, after core sand inside the sand blowing chamber 4 has been blown into the cavity 1*a* of the core box 1, the aeration air supply unit 9 and the compressed air supply unit 7 stop actuation thereof. Then, the core sand inside the sand blowing chamber 4 settles down due to gravity drop, thereby forming an air layer (gap) K between the upper face of core sand inside the sand blowing chamber 4 and the lower end (lower face) of the plate 4*a*.

Figure 10:
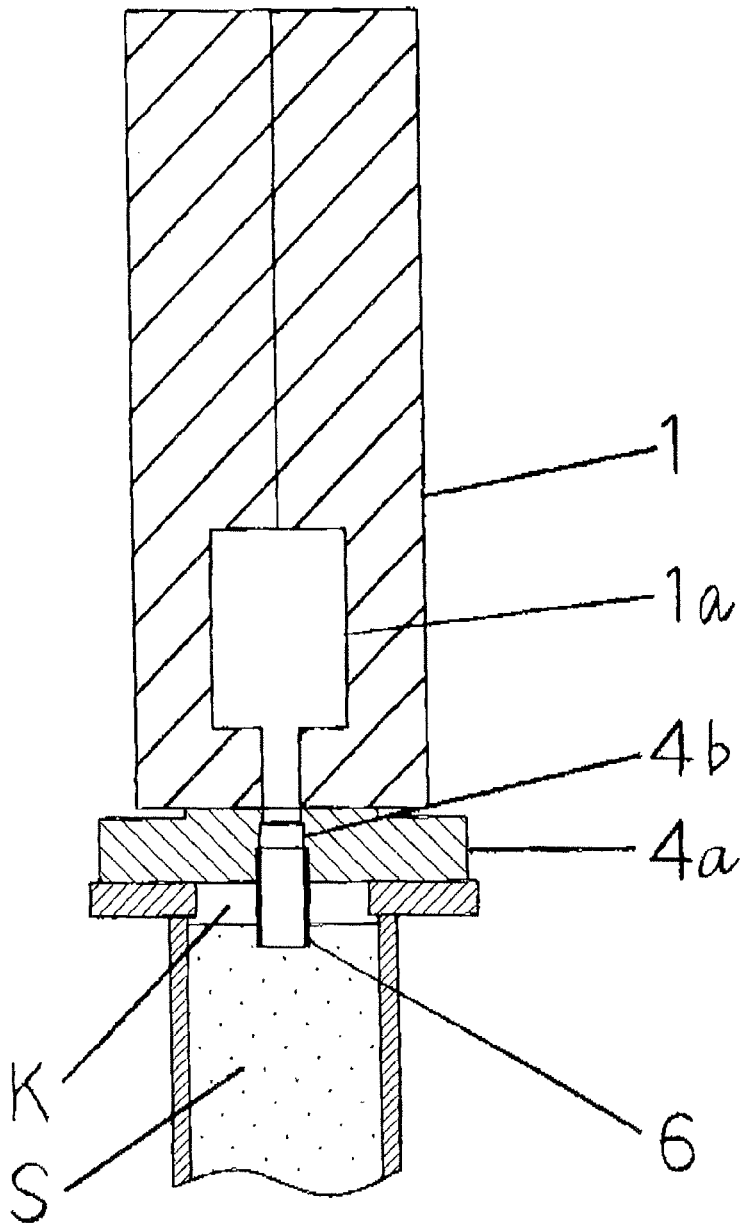
FIG. 10 is a partial front sectional view which shows a state that an air layer is formed between an upper face of core sand and a lower end of a plate in a sand blowing chamber.

FIG. 10 shows a state that the air layer K is formed (the symbol S indicates core sand). In this state, next, blowing is carried out for core sand into the cavity 1*a* of the core box 1. In the meantime, the leading end of the sand blowing nozzle 6 is kept buried into the core sand. Thereby, such an advantage is provided that the core sand is sufficiently filled into the cavity 1*a*, with no air in the air layer K involved with the core sand. Further, even on formation of the air layer K, the leading end of the sand blowing nozzle 6 is constantly kept buried into the core sand. Thus, there is no chance that core sand not solidified inside the cavity 1*a* will fall onto the air layer K. As a result, such an advantage is also provided that insufficient filling of core sand into the cavity 1*a* can be prevented. The above-described effects can be obtained in the Second Embodiment as well.

Further, in the First Embodiment and Second Embodiment, an internal thread is formed on an inner face of the sand blowing hole 4*b* and a male thread is also formed on an outer face of the sand blowing nozzle 6. And, they are screwed together, by which the sand blowing nozzle 6 is allowed to protrude from the lower end of the plate 4*a* and placed. The present invention shall not be, however, limited thereto. It is acceptable that the sand blowing nozzle 6 is placed at the lower end of the sand blowing hole 4*b* and the sand blowing nozzle 6 is firmly fixed to the plate 4*a* by welding or the like, thereby allowing the sand blowing nozzle 6 to protrude from the lower end of the plate 4*a*.

Further, in the First Embodiment and Second Embodiment, a cylindrical pipe is used as the sand blowing nozzle 6. However, the shape of the sand blowing nozzle 6 shall not be limited thereto and includes, for example, an oval shape.

In the First Embodiment and Second Embodiment, the aeration air supply unit 9 is actuated and after a predetermined period of time has passed, the compressed air supply unit 7 is actuated. The present invention shall not be, however, limited thereto. It is acceptable that when the pressure sensor 14 measures a predetermined pressure value inside the sand blowing chamber 4 after actuation of the aeration air supply unit 9, the compressed air supply unit 7 is actuated. In this case, the predetermined pressure value inside the sand blowing chamber 4 is preferably a value lower than a pressure at which the compressed air supply unit 7 is actuated. The pressure value is preferably in a range of 0.01 to 0.2 MPa.

Further, in the Second Embodiment, it is acceptable that the aeration air supply unit 9 and the second aeration air supply unit 21 are actuated or stopped in a synchronized manner or not in a synchronized manner. It is also acceptable that the compressed air supply unit 7 and the second compressed air supply unit 19 are actuated or stopped in a synchronized manner or not in a synchronized manner. When it is desired that the compressed air supply unit 7 and the second compressed air supply unit 19 are actuated or stopped at different timings, a special on-off valve may be communicatively connected to each of the compressed air supply unit 7 and the second compressed air supply unit 19.

Still further, in the First Embodiment and Second Embodiment, the blow head 2 is allowed to move up and down with respect to the core box 1 disposed at a predetermined position, to which the present invention shall not be, however, limited. It is acceptable that the core box 1 is allowed to move up and down with respect to the blow head 2 disposed at a predetermined position.

Still further, in the First Embodiment and Second Embodiment, as the core making machine, there is exemplified a shell core making machine in which resin-coated sand is blown and filled into a heated box to make a shell core, to which the present invention shall not be, however, limited. The present invention is also applicable to a case where core sand is filled into a core making machine by a cold box method which is an ordinary-temperature gas hardening process.

Still further, in the First Embodiment and Second Embodiment, the on/off gate 18 is opened and closed by the cylinder (not shown), to which the present invention shall not be, however, limited. It is acceptable that the on/off gate 18 is opened and closed by a cam mechanism.

In addition, in the First Embodiment and Second Embodiment, the aeration air supply unit 9 and the compressed air supply unit 7 are actuated or stopped in a synchronized manner, to which the present invention shall not be, however, limited. It is acceptable that the aeration air supply unit 9 is stopped earlier than the compressed air supply unit 7.

In the First Embodiment and Second Embodiment, pressures at which the aeration air supply unit 9, the second aeration air supply unit 21, the compressed air supply unit 7 and the second compressed air supply unit 19 are actuated are not limited to specific pressure values. It is, however, preferable that the aeration air supply unit 9, the second aeration air supply unit 21, the compressed air supply unit 7, and the second compressed air supply unit 19 are actuated respectively at 0.1 to 0.5 MPa, 0.1 to 0.5 MPa, 0.1 to 0.5 MPa, and 0.1 to 0.5 MPa.

Next, a description will be given of a core sand filling device of a Third Embodiment. In the Third Embodiment, as with the First Embodiment, as the core making machine, there is exemplified a shell core making machine in which resin-coated sand is blown and filled into a heated box to make a shell core. Further, in the present embodiment, there is exemplified an under-blow type core making machine in which core sand is blown from a lower part of a core box to an upper part of the core box. Drawings show a core sand filling device mainly used in the core making machine. Therefore, components of the core making machine other than the core sand filling device are not shown.

Figure 11:
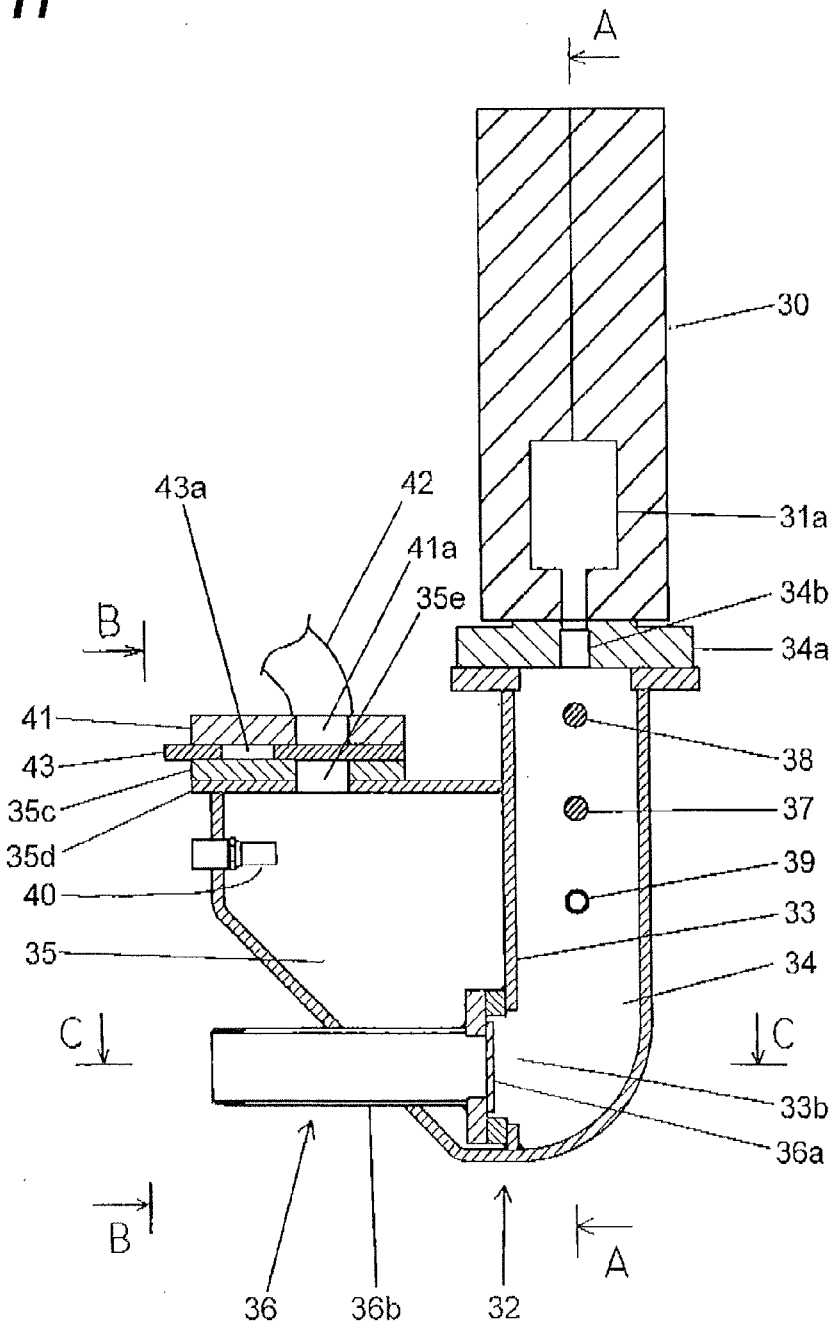
FIG. 11 is a front sectional view which shows a core sand filling device according to a Third Embodiment of the present invention.

In FIG. 11, below a mold-matched core box 30 (a box in the present embodiment), there is placed a blow head 32 capable of moving up and down in a relative manner to the core box 30. The blow head 32 is coupled to a lift cylinder (not shown). In the present embodiment, the blow head 32 is to move up and down with respect to the core box 30 disposed at a predetermined position.

The blow head 32 is divided into two chambers, that is, a sand blowing chamber 34 and a sand storage chamber 35 which are adjacent to each other by a partition plate 33 installed at an intermediate position. Thereby, the sand blowing chamber 34 and the sand storage chamber 35 are disposed substantially in a horizontal direction. Then, a plate 34*a* firmly attached to the core box 30 is attached to an upper end of the sand blowing chamber 34, and a sand blowing hole 34*b* for blowing core sand (not shown) inside the sand blowing chamber 34 into a cavity 31*a* of the core box 30 is drilled into the plate 34*a*. One or more vent holes (not shown) communicatively connected to the cavity 31*a* is drilled into the core box 30.

Figure 12:
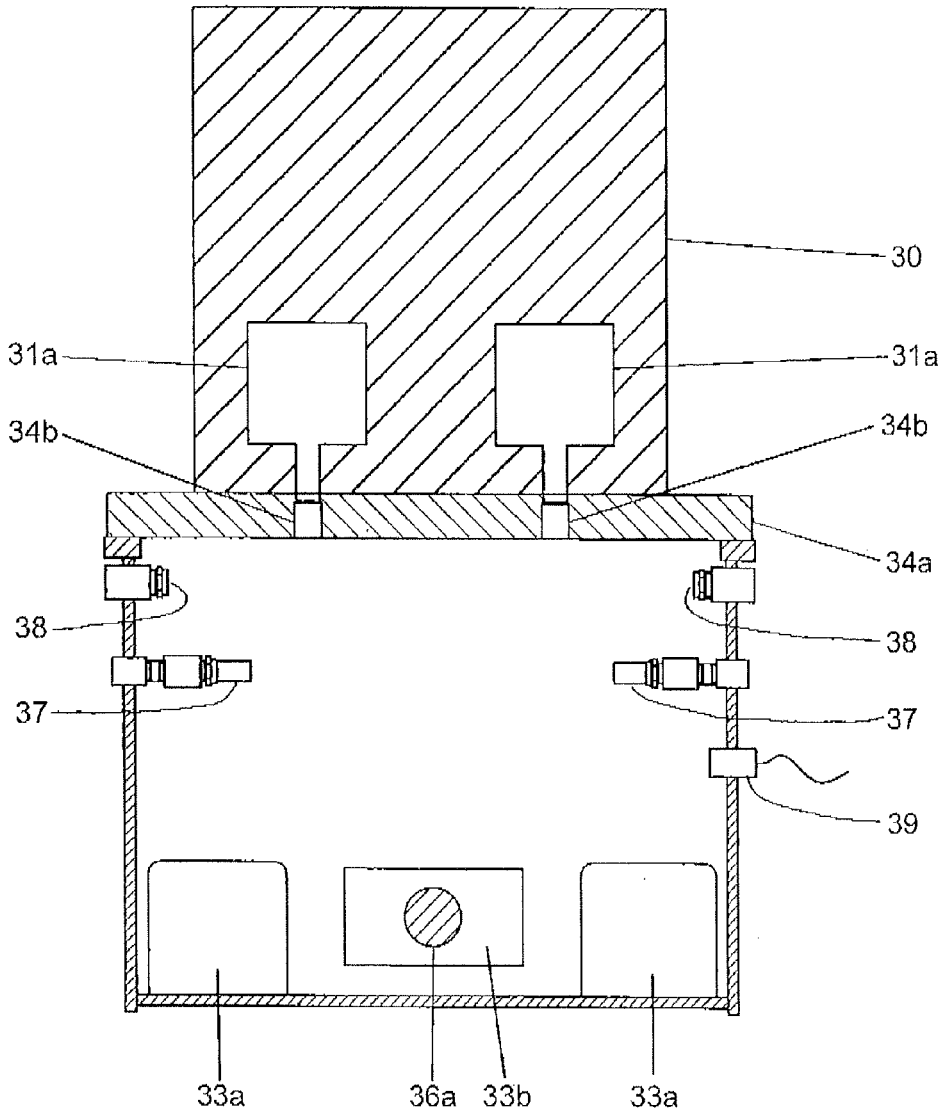
FIG. 12 is a sectional view taken along arrows A to A in FIG. 11.
Figure 13:
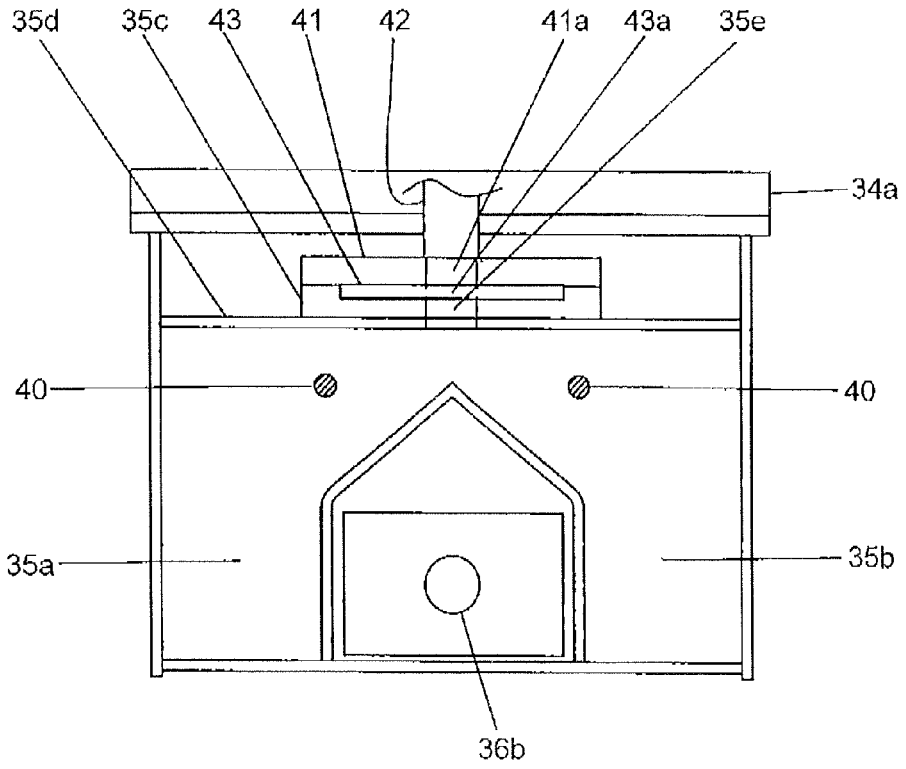
FIG. 13 is a sectional view taken along arrows B to B in FIG. 11.

Further, an opening 33*a* (refer to FIG. 12) is installed at each end of a lower part of the partition plate 33, and the sand blowing chamber 34 and the sand storage chamber 35 are communicatively connected to each other via the opening 33*a*. Still further, as shown in FIG. 13, the sand storage chamber 35 is branched and divided into a left chamber 35*a* and a right chamber 35*b*. The left chamber 35*a* and the right chamber 35*b* are communicatively connected at upper parts thereof. It is noted that at the left chamber 35*a* and the right chamber 35*b*, a part of the bottom face is made into an inclined face (refer to FIG. 11). Further, an upper face of a ceiling plate 35*d* of the sand storage chamber 35 is positioned lower than an upper face of the plate 34*a* of the sand blowing chamber 34.

Figure 14:
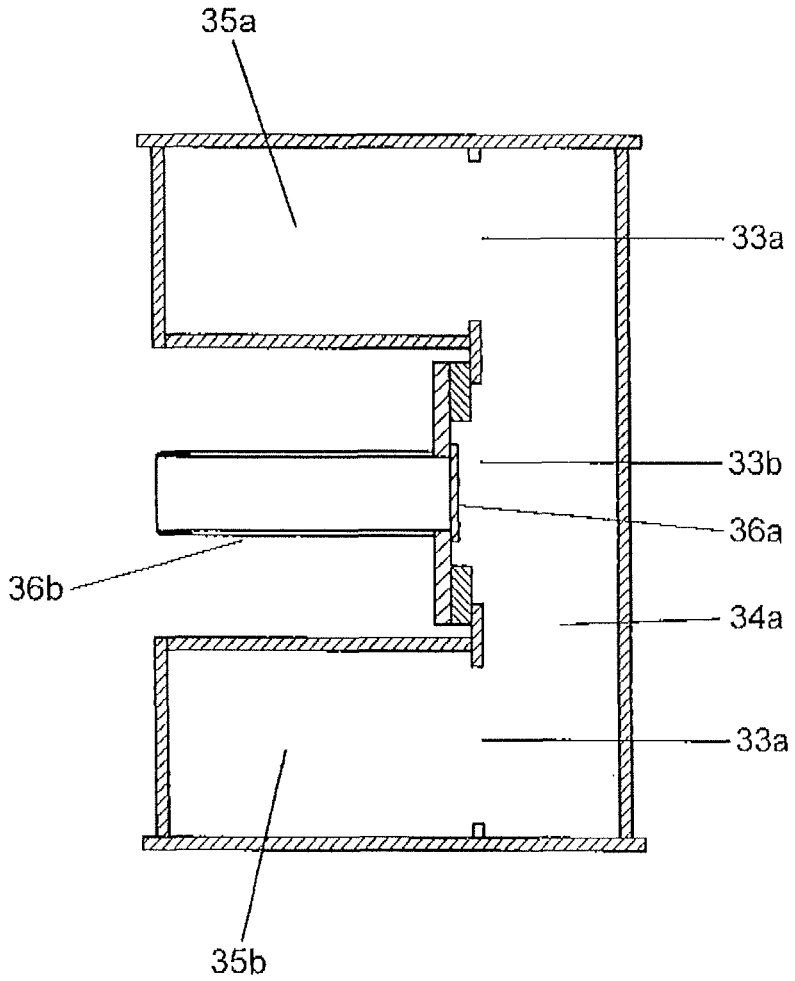
FIG. 14 is a sectional view taken along arrows C to C in FIG. 11.

Further, an opening 33*b* is provided at a lower center of the partition plate 33, and a compressed air supply unit 36 which supplies into the sand blowing chamber 34 compressed air for blowing into the core box 30 core sand inside the sand blowing chamber 34 is coupled outside the opening 33*b*. A compressed air introducing pipe 36*b* of the compressed air supply unit 36 is communicatively connected to the sand blowing chamber 34 via the opening 33*b*. It is noted that a bronze sintered body 36*a* is attached to the leading end of the compressed air introducing pipe 36*b*. Still further, the compressed air introducing pipe 36*b* is disposed between the left chamber 35*a* and the right chamber 35*b* in the sand storage chamber 35, that is, between the branch (refer to FIG. 13 and FIG. 14). In addition, the base end of the compressed air introducing pipe 36*b* is communicatively connected to a compressed air source (not shown) via an on-off valve (not shown).

Further, an aeration air supply unit 37 which supplies into the sand blowing chamber 34 aeration air for suspending and fluidizing core sand inside the sand blowing chamber 34 is attached to a side wall of the sand blowing chamber 34. A bronze sintered body (not shown) is attached to the leading end of the aeration air supply unit 37, and the aeration air supply unit 37 is communicatively connected to the sand blowing chamber 34 via the sintered body. Still further, the base end of the aeration air supply unit 37 is communicatively connected to the compressed air source (not shown) via an on-off valve (not shown).

Then, an air exhaustion unit 38 for exhausting compressed air remaining in the sand blowing chamber 34 is attached to an upper part of the aeration air supply unit 37 on the side wall of the sand blowing chamber 34. It is noted that a bronze sintered body (not shown) is attached to the leading end of the air exhaustion unit 38, and the air exhaustion unit 38 is communicatively connected to the sand blowing chamber 34 via the sintered body. Further, the base end of the air exhaustion unit 38 is communicatively connected to an on-off valve (not shown).

Then, a pressure sensor 39 for measuring a pressure inside the blow head 32 is attached to a lower part of the aeration air supply unit 37 on the side wall of the sand blowing chamber 34. Further, a sand-feeding air supply unit 40 which supplies into the sand storage chamber 35 compressed air for feeding core sand inside the sand storage chamber 35 into the sand blowing chamber 34 is attached to an upper part of each of the side walls of the left chamber 35*a* and the right chamber 35*b* in the sand storage chamber 35. It is noted that a bronze sintered body (not shown) is attached to the leading end of the sand-feeding air supply unit 40 and the sand-feeding air supply unit 40 is communicatively connected to the sand storage chamber 35 via the sintered body. Further, the base end of the sand-feeding air supply unit 40 is communicatively connected to a compressed air source (not shown) via an on-off valve (not shown).

Further, a plate material 35*c* is attached to the upper end of the sand storage chamber 35, and a sand hole 35*e* is drilled into each of the ceiling plate 35*d* and the plate material 35*c* in the sand storage chamber 35. Then, a flange 41 into which a through hole 41*a* is drilled is placed above the plate material 35*c*. A sand supply pipe 42 communicatively connected to the through hole 41*a* is firmly fixed to the upper end of the flange 41. It is noted that the sand supply pipe 42 is communicatively connected to a sand hopper (not shown) via a sand supply hose (not shown).

Then, an on/off gate 43 into which a communicating hole 43*a* is drilled is placed between the plate material 35*c* and the flange 41. The on/off gate 43 is opened and closed (to be moved laterally) by a cylinder (not shown). It is noted that where the blow head 32 is lowered by the lift cylinder (not shown), the plate material 35*c*, the on/off gate 43, the flange 41 and the sand supply pipe 42 are lowered together.

Figure 15:
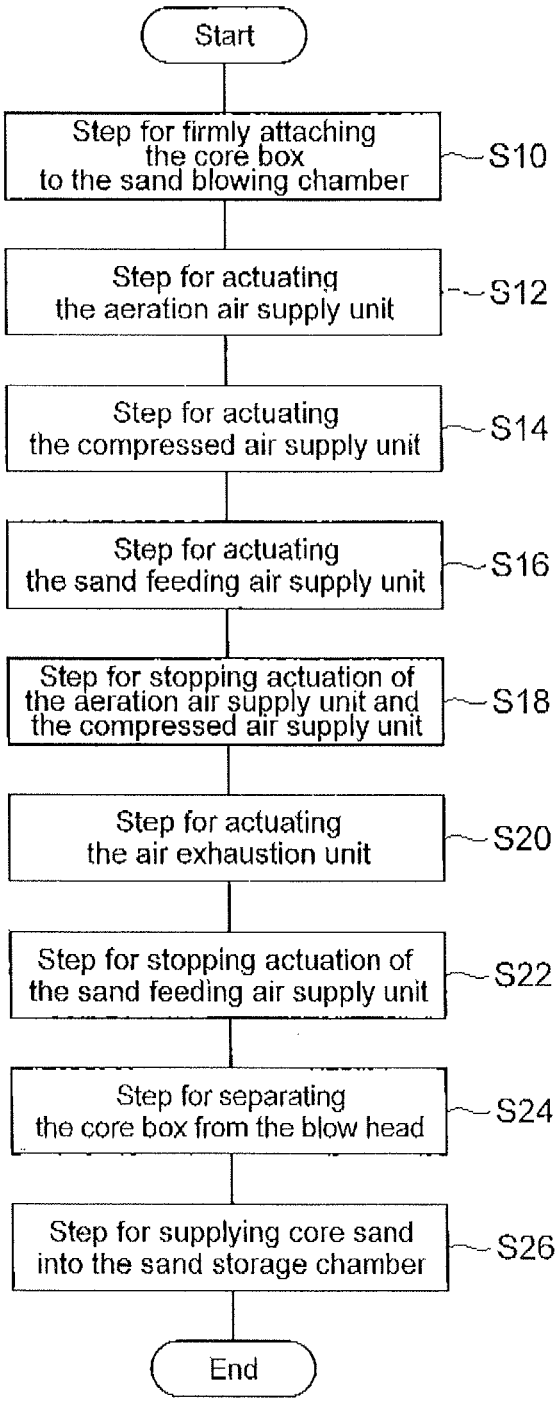
FIG. 15 is a flow chart which shows motions of the core sand filling device in the core making machine.

A description will be given of actuation of a core sand filling device used in the above-arranged core making machine. FIG. 15 is a flow chart which shows motions (core sand filling method) of the core sand filling device. As shown in FIG. 15, first, carried out is a step in which a core box 30 is firmly attached to a sand blowing chamber 34 (S10). First, the mold-matched core box 30 is disposed at a predetermined position. Then, the on/off gate 43 is closed by a cylinder (not shown). The blow head 32 is raised by the lift cylinder (not shown) to develop the state in FIG. 11. It is noted that in the state in FIG. 11, the core box 30 and the plate 34*a* are firmly attached to each other. Further, the sand hole 35*e* is blocked by the on/off gate 43 to airtight seal the blow head 32. Still further, core sand (not shown) is contained at a necessary quantity in each of the sand blowing chamber 34 and the sand storage chamber 35.

Next, in the state in FIG. 11, the on-off valve (not shown) is opened to actuate the aeration air supply unit 37 (S12). And, compressed air (that is, aeration air) is ejected from the sintered body attached to the leading end of the aeration air supply unit 37, by which core sand inside the sand blowing chamber 34 is suspended and fluidized. Then, after a predetermined period of time has passed, the on-off valve (not shown) is opened to actuate the compressed air supply unit 36 (S14). Thereby, compressed air is ejected from the sintered body 36*a* attached to the leading end of the compressed air introducing pipe 36*b*, and the core sand inside the sand blowing chamber 34 is blown into a cavity 31*a* of the core box 30 via the sand blowing hole 34*b*. In the meantime, the compressed air blown into the cavity 31*a* together with the core sand is exhausted through the vent holes (not shown).

Then, after a predetermined period of time has passed, the on-off valve (not shown) is opened to actuate the sand-feeding air supply unit 40 (S16). Thereby, compressed air (that is, sand-feeding air) is ejected from the sintered body attached to the leading end of the sand-feeding air supply unit 40, by which core sand inside the sand storage chamber 35 is fed into the sand blowing chamber 34. Then, after a predetermined period of time has passed from start of actuating the sand-feeding air supply unit 40, the on-off valve (not shown) is closed to stop actuation of the aeration air supply unit 37 and the compressed air supply unit 36 (S18). In this case, since a pressure which is going to move into the cavity 31*a* of the core box 30 acts on core sand inside the sand blowing chamber 34 and the sand storage chamber 35, core sand filled inside the cavity 31*a* does not drop.

Then, after a predetermined period of time has passed from stop of actuation of the aeration air supply unit 37 and the compressed air supply unit 36, the on-off valve (not shown) is opened to actuate the air exhaustion unit 38 (S20). Thereby, compressed air remaining in the sand blowing chamber 34 is exhausted. In the meantime, such flow of air is developed that compressed air remaining in the sand blowing chamber 40 is exhausted from the air exhaustion unit 38. Thus, core sand inside the sand storage chamber 35 joins the flow and moves into the sand blowing chamber 34, by which the sand blowing chamber 34 is filled with the core sand.

Then, after a predetermined period of time has passed from start of actuating the air exhaustion unit 38, the on-off valve (not shown) is closed to stop actuation of the sand-feeding air supply unit 40 (S22). After the pressure sensor 39 has measured that the pressure inside the blow head 32 is zero, the blow head 32 is lowered by the lift cylinder (not shown) and the core box 30 is separated from the blow head 32 (S24). Then, the on-off valve (not shown) is closed which is communicatively connected to the air exhaustion unit 38.

Then, after horizontal movement of the core box 30 to a different position, the box is opened to take out a core. Then, the on/off gate 43 is opened by the cylinder (not shown). Thereby, core sand inside the sand hopper is supplied into the sand storage chamber 35 through the sand supply pipe 42, the through hole 41*a*, the communicating hole 43*a* and the sand blowing hole 35*e* (S26).

In the above-described embodiment, the aeration air supply unit 37, the compressed air supply unit 36 and the sand-feeding air supply unit 40 are actuated at the same pressure. The same actuation pressure is advantageous in reducing consumption of air.

In one embodiment, as described above, the aeration air supply unit 37, the compressed air supply unit 36 and the sand-feeding air supply unit 40 are actuated at the same pressure, to which the present invention shall not be, however, limited. It is acceptable that the sand-feeding air supply unit 40 is actuated at a pressure higher than a pressure at which the aeration air supply unit 37 and the compressed air supply unit 36 is actuated. In this case, there is provided such an advantage that core sand inside the sand storage chamber 35 is fed into the sand blowing chamber 34 smoothly and continuously due to a difference between a pressure at which the sand-feeding air supply unit 40 is actuated and a pressure at which the aeration air supply unit 37 and the compressed air supply unit 36 is actuated. Further, in this case, a pressure at which the sand-feeding air supply unit 40 is actuated is preferably higher than a pressure at which the aeration air supply unit 37 and the compressed air supply unit 36 is actuated. It is acceptable that the aeration air supply unit 37 and the compressed air supply unit 36 are actuated at the same pressure or not at the same pressure.

In one embodiment, such an arrangement is made that the blow head 32 divided into the sand blowing chamber 34 and the sand storage chamber 35 which are communicatively connected to each other is placed below the core box 30 so as to move up and down in a relative manner to the core box 30. Thereby, as compared with a top-blow type core making machine, the device of this embodiment can be decreased in width in a perpendicular direction to provide effects that it can be downsized. There is also provided such an arrangement that, with the sand blowing chamber 34 and the sand storage chamber 35 disposed substantially in a horizontal direction, the compressed air supply unit 36 is mounted in a horizontal direction and the sand supply pipe 42 is mounted at the upper end of the sand storage chamber 35 and the device is thereby further decreased in width in a perpendicular direction. Further, in one embodiment, three air supply units are provided, that is, the compressed air supply unit 36 which is communicatively connected to the sand blowing chamber 34 and also supplies into the sand blowing chamber 34 compressed air for blowing core sand inside the sand blowing chamber 34 into the core box 30, the aeration air supply unit 37 which is communicatively connected to the sand blowing chamber 34 and also supplies into the sand blowing chamber 34 aeration air for suspending and fluidizing core sand inside the sand blowing chamber 35, and the sand-feeding air supply unit 40 which is communicatively connected to the sand storage chamber 35 and also supplies into the sand storage chamber 35 compressed air for feeding core sand inside the sand storage chamber 35 into the sand blowing chamber 34. And, compressed air ejected from each of the air supply units is combined to blow and fill the core sand, thereby such effects are provided that the core sand can be filled with improved filling property even by an under-blow type core making machine.

In one embodiment, the aeration air supply unit 37 is actuated and after a predetermined period of time has passed, the compressed air supply unit 36 is actuated, to which the present invention shall not be, however, limited. It is acceptable that the compressed air supply unit 36 is actuated after the aeration air supply unit 37 has been actuated and the pressure sensor 39 has detected a predetermined pressure value inside the blow head 32. In this case, it is also acceptable that the predetermined pressure value inside the blow head 32 is a pressure value lower than a pressure at which the compressed air supply unit 36 is actuated. The pressure value may be, for example, in a range of 0.01 to 0.2 MPa.

In one embodiment, the blow head 32 is to move up and down with respect to the core box 30 disposed at a predetermined position, to which the present invention shall not be, however, limited. It is acceptable that the core box 30 is to move up and down with respect to the blow head 32 disposed at a predetermined position.

Further, in one embodiment, as the core making machine, there is exemplified a shell core making machine in which resin-coated sand is blown and filled into a heated box to make a shell core, to which the present invention shall not be, however, limited. The present invention is also applicable to core sand filled into a core making machine by using cold box method which is an ordinary-temperature gas hardening process.

In one embodiment, pressures at which the aeration air supply unit 37, the compressed air supply unit 36 and the sand-feeding air supply unit 40 are actuated shall not be limited to specific pressure values. The aeration air supply unit 37, the compressed air supply unit 36 and the sand-feeding air supply unit 40 may be actuated, for example, at the respective pressures of 0.1 to 0.5 MPa, 0.1 to 0.5 MPa and 0.1 to 0.5 MPa.

Further, in one embodiment, the on/off gate 43 is opened and closed by the cylinder (not shown), to which the present invention shall not be, however, limited. It is acceptable that the on/off gate 43 is opened and closed by a cam mechanism.

Still further, in one embodiment, the sand storage chamber 35 is branched and divided into the left chamber 35*a* and the right chamber 35*b*, to which the present invention shall not be, however, limited. Such an arrangement is acceptable that the sand storage chamber 35 has one chamber (single chamber). In this case, for example, the compressed air supply unit 36 is to penetrate through the sand storage chamber 35.

Figure 16:
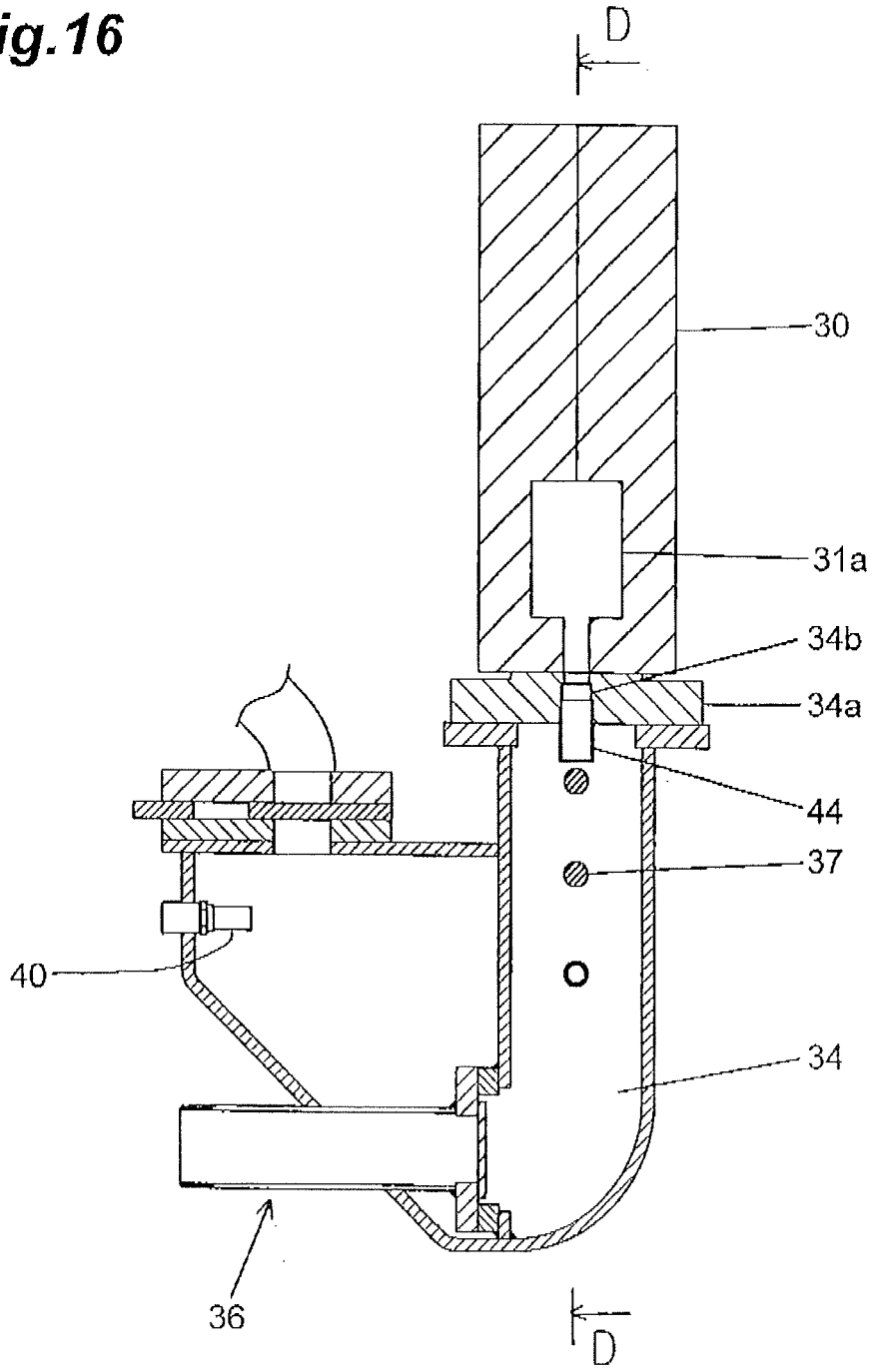
FIG. 16 is a front sectional view of a core sand filling device according to a Fourth Embodiment of the present invention.
Figure 17:
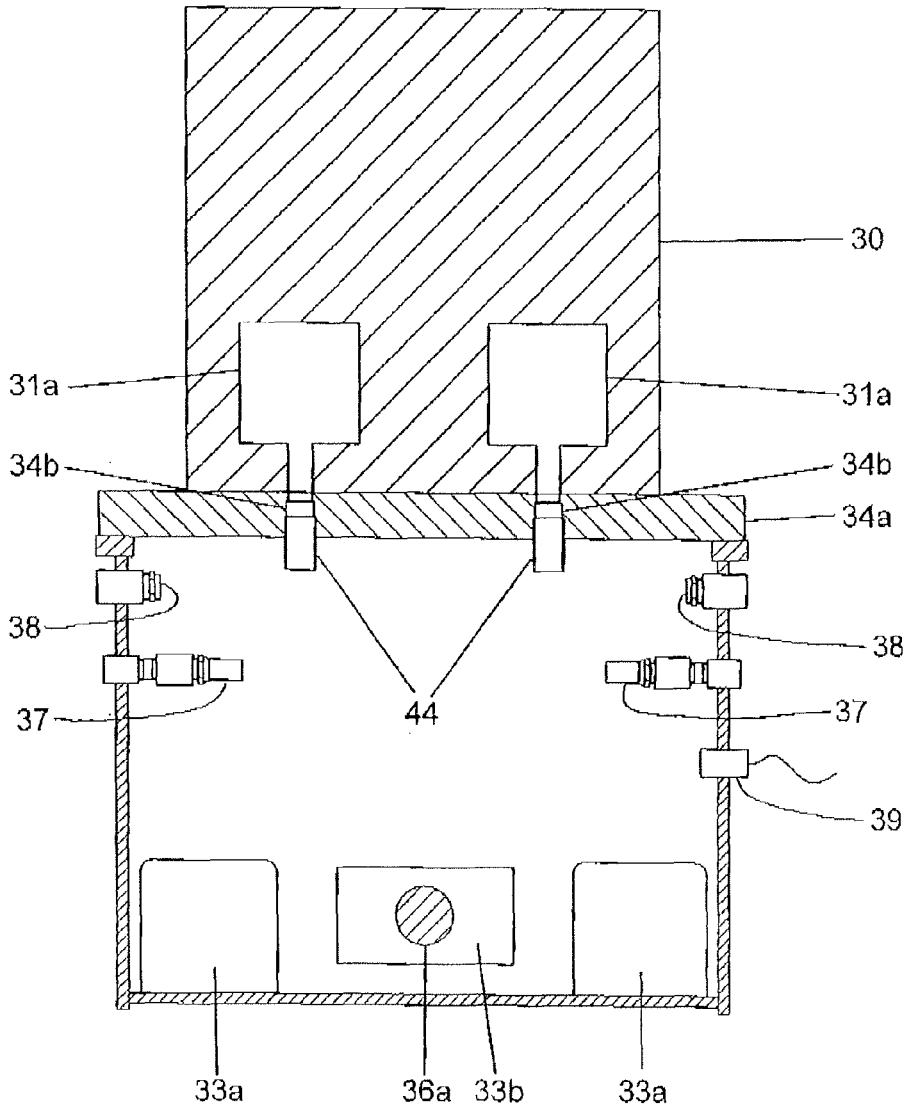
FIG. 17 is a sectional view taken along arrows D to D in FIG. 16.

Next, a description will be given of a Fourth Embodiment which is different from the Third Embodiment. First, a difference in arrangement between the Third Embodiment and Fourth Embodiment will be explained. In the Fourth Embodiment, as shown in FIG. 16 and FIG. 17, a sand blowing nozzle 44 is placed at a lower end of a sand blowing hole 34*b* drilled into a plate 34*a* attached to an upper end of a sand blowing chamber 34 so as to protrude from the lower end of the plate 34*a*. It is noted that the sand blowing hole 34*b* and the sand blowing nozzle 44 are communicatively connected to each other. This is different from the Third Embodiment. Other points are the same as those of the Third Embodiment. The same components as those of the Third Embodiment are given the same reference numerals, with a description thereof omitted here. Actuation of the above-arranged Fourth Embodiment is similar to that of the Third Embodiment, the description of which will be omitted here. In the Fourth Embodiment, core sand inside the sand blowing chamber 34 is blown into a cavity 31*a* of a core box 30 via the sand blowing nozzle 44 and the sand blowing hole 34*b*, only which is different from the Third Embodiment.

Next, a detailed description will be given of effects that the sand blowing nozzle 44 is placed at the lower end of the sand blowing hole 34*b* drilled into the plate 34*a* attached to the upper end of the sand blowing chamber 34 so as to protrude from the lower end of the plate 34*a*. In the Third Embodiment and Fourth Embodiment of the present invention, as described above, after core sand inside the sand blowing chamber 34 has been blown into the cavity 31*a* of the core box 30, the aeration air supply unit 37, the compressed air supply unit 36 and sand-feeding air supply unit 40 stop actuation thereof. Thereby, core sand inside the sand blowing chamber 34 settles down due to gravity drop to form an air layer (gap) K between the upper face of core sand inside the sand blowing chamber 34 and the lower end (lower face) of the plate 34*a* (refer to FIG. 18 and FIG. 19).

Figure 18:
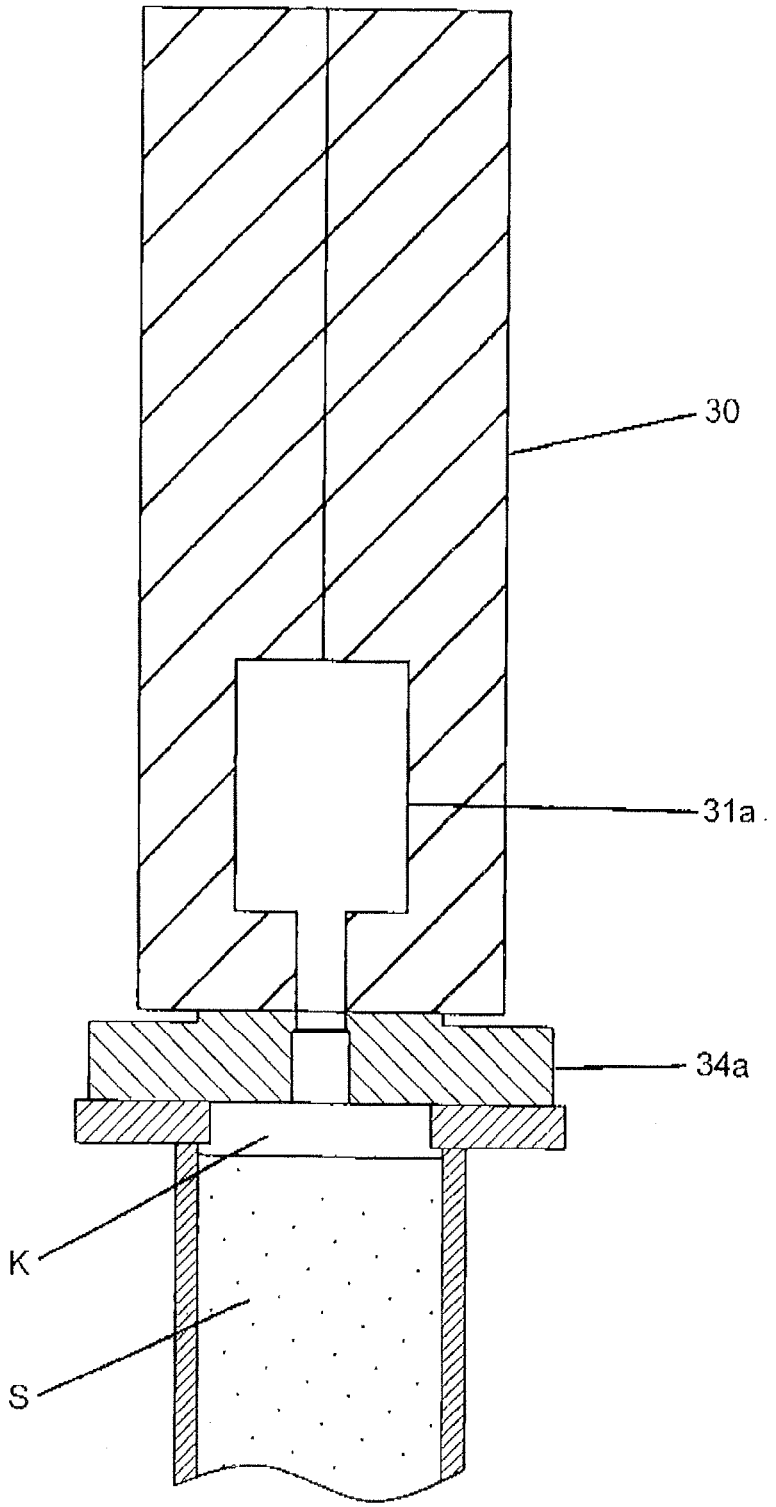
FIG. 18 is a partial front sectional view which shows a state that an air layer is formed between an upper face of core sand and a lower end of a plate in the sand blowing chamber in the Third Embodiment.

FIG. 18 shows a state that the air layer K is formed (the symbol S indicates core sand). In the Third Embodiment, in this state, carried out is next blowing of core sand into the cavity 31*a* of the core box 30. However, here, core sand is blown into the cavity 31*a* together with air of the air layer K, by which there is a case that core sand is not sufficiently filled into the cavity 31*a*. Further, where the air layer K is formed, core sand which is not solidified inside the cavity 31*a* may thereafter fall onto the air layer K, thus resulting in insufficient filling of core sand into the cavity 31*a*.

Figure 19:
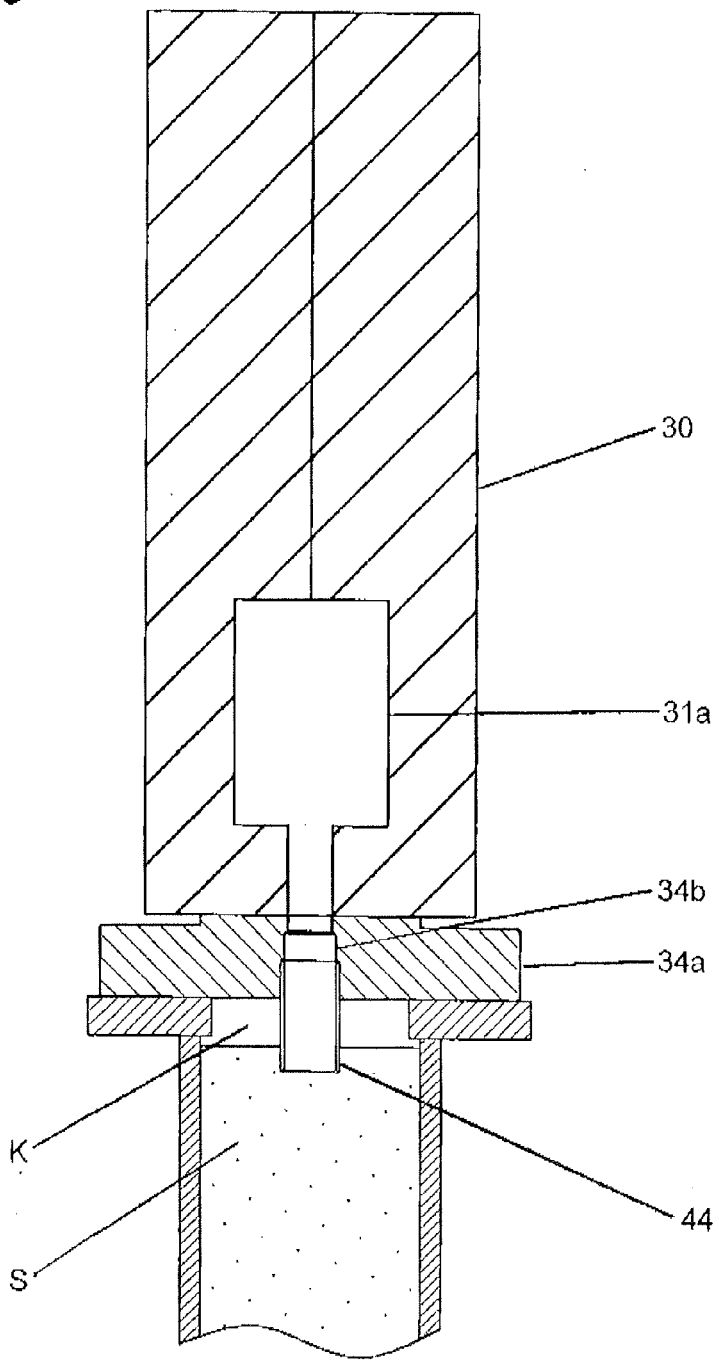
FIG. 19 is a partial front sectional view which shows a state that an air layer is formed between an upper face of core sand and a lower end of a plate in the sand blowing chamber in the Fourth Embodiment.

FIG. 19 shows a state that the air layer K is formed in the Fourth Embodiment (the symbol S indicates core sand). In the Fourth Embodiment, in this state, carried out is next blowing of core sand into the cavity 31*a* of the core box 30. In the meantime, the leading end of the sand blowing nozzle 44 is kept buried into the core sand. Thereby, such an advantage is provided that the core sand is sufficiently filled into the cavity 31*a*, with no air of the air layer K involved with the core sand. Further, even where the air layer K is formed, the leading end of the sand blowing nozzle 44 is constantly kept buried into the core sand. Thus, there is no chance that core sand which is not solidified inside the cavity 31*a* falls onto the air layer K. As a result, such an advantage is also provided that insufficient feeding of core sand into the cavity 31*a* can be prevented. Such an arrangement is made that the sand blowing nozzle 44 is placed at the lower end of the sand blowing hole 34*b* drilled into the plate 34*a* attached to the upper end of the sand blowing chamber 34 so as to protrude from the lower end of the plate 34*a*, thereby providing the above-described advantage.

In the Fourth Embodiment, the internal thread is formed on an inner face of the sand blowing hole 34*b* and the external thread is formed on an outer face of the sand blowing nozzle 44 to screw them together. Thereby, the sand blowing nozzle 44 is allowed to protrude from the lower end of the plate 34*a* and placed. However, the present invention shall not be limited thereto. It is acceptable that the sand blowing nozzle 44 is placed at the lower end of the blowing hole 34*b* and the sand blowing nozzle 44 is firmly fixed to the plate 34*a* by welding or the like, thereby, allowing the sand blowing nozzle 44 to protrude from the lower end of the plate 34*a*.

Further, in the Fourth Embodiment, a cylindrical pipe is used as the sand blowing nozzle 44. The shape of the sand blowing nozzle 44 shall not be limited thereto and may include, for example, an oval shape.

Still further, in the Third Embodiment and Fourth Embodiment, the plate 34*a* attached to the upper end of the sand blowing chamber 34 is arranged so as to be detached from the upper end of the sand blowing chamber 34. A unit which is capable of detaching the plate 34*a* from the upper end of the sand blowing chamber 34 includes, for example, a connection unit and a clamp unit.

REFERENCE SIGNS LIST

1: core box, 2: blow head, 4: sand blowing chamber, 4*a*: plate 4*b*: sand blowing hole, 5: sand storage chamber, 5*a*: inclined face, 6: sand blowing nozzle, 7: compressed air supply unit, 9: aeration air supply unit, 10: air pipe, 13: exhaust valve, 14: pressure sensor for measuring pressure inside sand blowing chamber, 15: pressure sensor for measuring pressure inside sand storage chamber, 19: second compressed air supply unit, 21: second aeration air supply unit.

The invention claimed is:

1. A core sand filling device in an under-blow type core making machine in which core sand is blown from a lower part of a core box to an upper part of the core box, the core sand filling device in the core making machine comprising:

the core box;

a blow head which is placed below the core box so as to move up and down in a relative manner to the core box and divided into a sand blowing chamber and a sand storage chamber that are communicatively connected to each other;

a compressed air supply unit which is communicatively connected to the sand storage chamber and supplies compressed air into the sand storage chamber;

an aeration air supply unit which is communicatively connected to the sand blowing chamber and supplies into the sand blowing chamber aeration air for suspending and fluidizing core sand inside the sand blowing chamber; and an exhaust valve which is communicatively connected to the sand blowing chamber and exhausts compressed air remaining in the sand blowing chamber.

2. The core sand filling device in the core making machine according to claim 1, wherein a second compressed air supply unit which supplies compressed air into the sand storage chamber is communicatively connected to the sand storage chamber.

3. The core sand filling device in the core making machine according to claim 1, wherein a second aeration air supply unit which supplies into the sand blowing chamber aeration air for suspending and fluidizing core sand inside the sand blowing chamber is communicatively connected to the sand blowing chamber.

4. The core sand filling device in the core making machine according to claim 1, wherein a part of a bottom face of the sand storage chamber is made into an inclined face and the compressed air supply unit is attached to the inclined face.

5. The core sand filling device in the core making machine according to claim 1, wherein the exhaust valve is communicatively connected to the sand blowing chamber via an air pipe which is communicatively connected to the aeration air supply unit.

6. The core sand filling device in the core making machine according to claim 1, wherein a pressure sensor for measuring a pressure inside the sand blowing chamber is attached to the sand blowing chamber and a pressure sensor for measuring a pressure inside the sand storage chamber is also attached to the sand storage chamber.

7. The core sand filling device in the core making machine according to claim 1, wherein a sand blowing nozzle is placed at a lower end of a sand blowing hole drilled into a plate attached to an upper end of the sand blowing chamber so as to protrude from the lower end of the plate.

8. A core sand filling method employed in the core making machine using the core sand filling device in the core making machine according to claim 1, the core sand filling method employed in the core making machine comprising:

a step which firmly attaches the core box to the sand blowing chamber;

a step which actuates the aeration air supply unit to suspend and fluidize core sand inside the sand blowing chamber;

a step which actuates the compressed air supply unit, thereby feeding core sand inside the sand storage chamber into the sand blowing chamber and also blowing core sand inside the sand blowing chamber into the core box;

a step which stops actuation of the aeration air supply unit;

a step which stops actuation of the compressed air supply unit; and a step which actuates the exhaust valve to exhaust compressed air remaining in the sand blowing chamber.

9. The core sand filling method employed in the core making machine according to claim 8, wherein the aeration air supply unit and the compressed air supply unit are actuated at the same pressure.

10. The core sand filling method employed in the core making machine according to claim 8, wherein a pressure for actuating the compressed air supply unit is set higher than a pressure for actuating the aeration air supply unit.

11. The core sand filling device in the core making machine according to claim 2, wherein a second aeration air supply unit which supplies into the sand blowing chamber aeration air for suspending and fluidizing core sand inside the sand blowing chamber is communicatively connected to the sand blowing chamber.

12. The core sand filling device in the core making machine according to claim 2, wherein a part of a bottom face of the sand storage chamber is made into an inclined face and the compressed air supply unit is attached to the inclined face.

13. The core sand filling device in the core making machine according to claim 2, wherein the exhaust valve is communicatively connected to the sand blowing chamber via an air pipe which is communicatively connected to the aeration air supply unit.

14. The core sand filling device in the core making machine according to claim 2, wherein a pressure sensor for measuring a pressure inside the sand blowing chamber is attached to the sand blowing chamber and a pressure sensor for measuring a pressure inside the sand storage chamber is also attached to the sand storage chamber.

15. The core sand filling device in the core making machine according to claim 2, wherein a sand blowing nozzle is placed at a lower end of a sand blowing hole drilled into a plate attached to an upper end of the sand blowing chamber so as to protrude from the lower end of the plate.

* * * * *